US007105257B2

(12) United States Patent
Yamada et al.

(10) Patent No.: US 7,105,257 B2
(45) **Date of Patent: *Sep. 12, 2006**

(54) ELECTROPHOTOGRAPHIC PHOTORECEPTOR, PROCESS CARTRIDGE AND IMAGE FORMING APPARATUS

(75) Inventors: Wataru Yamada, Kanagawa (JP); Katsumi Nukada, Kanagawa (JP); Kazuhiro Koseki, Kanagawa (JP); Takayuki Yamashita, Kanagawa (JP); Masahiro Iwasaki, Kanagawa (JP); Takahiro Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 163 days.

This patent is subject to a terminal disclaimer.

(21) Appl. No.: 10/648,273

(22) Filed: Aug. 27, 2003

(65) Prior Publication Data

US 2004/0086794 A1 May 6, 2004

(30) Foreign Application Priority Data

Aug. 28, 2002 (JP) ..... 2002-249593

(51) Int. Cl.
*G03G 5/47* (2006.01)

(52) U.S. Cl. ..... 430/56; 430/58.2; 430/66; 399/159

(58) Field of Classification Search ..... 430/56, 430/58.2, 66; 339/159
See application file for complete search history.

(56) References Cited

U.S. PATENT DOCUMENTS

| | | | | |
|---|---|---|---|---|
| 6,352,809 | B1 * | 3/2002 | Nukada et al. | 430/127 |
| 6,372,398 | B1 * | 4/2002 | Yamada et al. | 430/66 |
| 6,485,835 | B1 * | 11/2002 | Heeks et al. | 428/421 |
| 6,562,530 | B1 * | 5/2003 | Morikawa et al. | 430/66 |
| 6,933,088 | B1 * | 8/2005 | Yamada et al. | 430/58.2 |

FOREIGN PATENT DOCUMENTS

| | | |
|---|---|---|
| JP | A 57-128344 | 8/1982 |
| JP | B2 60-22347 | 6/1985 |
| JP | A 63-65449 | 3/1988 |
| JP | A 4-15659 | 1/1992 |
| JP | B2 5-47104 | 7/1993 |
| JP | A 10-251277 | 9/1998 |
| JP | A 11-38656 | 2/1999 |
| JP | A 11-184106 | 7/1999 |
| JP | A 11-316468 | 11/1999 |

* cited by examiner

*Primary Examiner*—John L Goodrow
(74) *Attorney, Agent, or Firm*—Oliff & Berridge, PLC

(57) ABSTRACT

An electrophotographic photoreceptor comprising a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5. \quad (1)$$

13 Claims, 3 Drawing Sheets

ELECTROPHOTOGRAPHIC PHOTORECEPTOR, PROCESS CARTRIDGE AND IMAGE FORMING APPARATUS

FIELD OF THE INVENTION

The present invention relates to an electrophotographic photoreceptor, a process cartridge and an image forming apparatus.

RELATED ART OF THE INVENTION

In image forming apparatus such as copiers, printers and facsimiles, electrophotographic systems in which charging, exposure, development, transfer, etc. are carried out using electrophotographic photoreceptors have been widely employed. In such image forming apparatus, demands for speeding up of image formation processes, improvement in image quality, miniaturization and prolonged life of the apparatus, reduction in production cost and running cost, etc. are increasingly glowing. Further, with recent advances in computers and communication technology, digital systems and color image output systems have been applied also to the image forming apparatus.

In view of such a background, improvement in electrophotographic properties and durability, miniaturization, reduction in cost, etc. in electrophotographic photoreceptors have been studied, and electrophotographic photoreceptors using various materials have been proposed.

For example, JP-A-63-65449 (the term "JP-A" as used herein means an "unexamined published Japanese patent application") discloses an electrophotographic photoreceptor in which fine silicone particles are added to a photosensitive layer, and also discloses that such addition of the fine silicone particles imparts lubricity to a surface of the photoreceptor.

Further, in forming a photosensitive layer, a method has been proposed in which a charge transfer substance is dispersed in a binder polymer or a polymer precursor thereof, and then the binder polymer or the polymer precursor thereof is cured. JP-B-5-47104 (the term "JP-B" as used herein means an "examined Japanese patent publication") and JP-B-60-22347 disclose electrophotographic photoreceptors using silicone materials as the binder polymers or the polymer precursors thereof.

Furthermore, in order to improve mechanical strength of the electrophotographic photoreceptor, a protective layer is formed on the surface of the photosensitive layer in some cases. A crosslinkable resin is used as a material for the protective layer in many cases. However, the protective layer formed by the crosslinkable resin acts as an insulating layer, which impairs the photoelectric characteristics of the photoreceptor. For this reason, a method of dispersing a fine conductive metal oxide powder (JP-A-57-128344) or a charge transfer substance (JP-A-4-15659) in the protective layer and a method of reacting a charge transfer substance having a reactive functional group with a thermoplastic resin to form the protective layer have been proposed.

However, even the above-mentioned conventional electrophotographic photoreceptor is not necessarily sufficient in electrophotographic characteristics and durability, particularly when it is used in combination with a charger of the contact charging system (contact charger) or a cleaning apparatus such as a cleaning blade.

Further, when the photoreceptor is used in combination with the contact charger and a toner obtained by chemical polymerization (polymerization toner), a surface of the photoreceptor is stained with a discharge product produced in contact charging or the polymerization toner remaining after a transfer step to deteriorate image quality in some cases. Still further, the use of the cleaning blade in order to remove the discharge product adhered to the surface of the photoreceptor or the remaining toner increases friction and abrasion between the surface of the photoreceptor and the cleaning blade, resulting in a tendency to cause damage of the surface of the photoreceptor, breakage of the blade or turning up of the blade.

Furthermore, in producing the electrophotographic photoreceptor, in addition to improvement in electrophotographic characteristics and durability, it becomes an important problem to reduce production cost. However, in the case of the conventional electrophotographic photoreceptor, the problem is encountered that coating defects such as orange peel appearances and hard spots are liable to occur.

On the other hand, the present inventors discovered that the use of charge transfer substances having hydrolytic silyl groups improves electrophotographic characteristics and durability, and have disclosed electrophotographic photoreceptors using them in JP-A-11-38656, JP-A-11-184106 and JP-A-11-316468. The inventors have further disclosed an electrophotographic photoreceptor in which a reactive siloxane oil is allowed to exist in a film and an electrophotographic photoreceptor using a fluorine coupling agent or PTFE, in JP-A-10-251277 and JP-A-11-38656, respectively. However, there has been room for further improvement in electrophotographic characteristics and durability.

SUMMARY OF THE INVENTION

The invention has been made in view of the problems of the above-mentioned related art.

Accordingly, an object of the invention is to provide an electrophotographic photoreceptor which is sufficiently high in stain resistance against a developing agent, a discharge product, etc. and in durability against a contact charger, a cleaning blade, etc., and further, which can prevent the occurrence of coating defects in the production thereof.

Another object of the invention is to provide a process cartridge and an image forming apparatus which can provide good image quality for a long period of time.

Other objects and effects of the invention will become apparent from the following description.

The above-described objects of the invention have been achieved by providing:

an electrophotographic photoreceptor comprising a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5 \quad (1).$$

In the electrophotographic photoreceptor of the invention, the photosensitive layer comprises a silicon compound-containing layer, and the silicon compound-containing layer further contains the resin to cause a peak area in the region of −40 to 0 ppm and a peak area in the region of −100 to −50 ppm in a $^{29}$Si-NMR spectrum to satisfy the above-shown equation (1), thereby enhancing discharge gas resistance, mechanical strength, scratch resistance, particle dispersibility, etc. It becomes therefore possible to sufficiently improve the stain resistance against the developing agent, the discharge product, etc. and the durability against the contact charger, the cleaning blade, etc. Further, the above-mentioned constitution of the photosensitive layer makes it possible to prevent the occurrence of coating defects, because the viscosity control of a coating solution in the production becomes easy, and the pot life can be sufficiently prolonged.

Further, the process cartridge of the invention comprises the above-mentioned electrophotographic photoreceptor of the invention, and at least one of: a developing unit for developing an electrostatic latent image formed on the electrophotographic photoreceptor to form a toner image; and a cleaning unit for removing toner remaining on the electrophotographic photoreceptor after transfer of the toner image.

Furthermore, the image forming apparatus of the invention comprises the above-mentioned electrophotographic photoreceptor of the invention, a charging unit for charging the electrophotographic photoreceptor, an exposing unit for exposing the charged electrophotographic photoreceptor to form an electrostatic latent image, a developing unit for developing the electrostatic latent image to form a toner image, a transfer unit for transferring the toner image to a medium to which the toner image is to be transferred, and a cleaning unit for removing toner remaining on the electrophotographic photoreceptor after transfer of the toner image.

The process cartridge and the image forming apparatus which can provide good image quality for a long period of time becomes feasible by using the electrophotographic photoreceptor of the invention as described above.

DETAILED DESCRIPTION OF THE INVENTION

Figure 1:
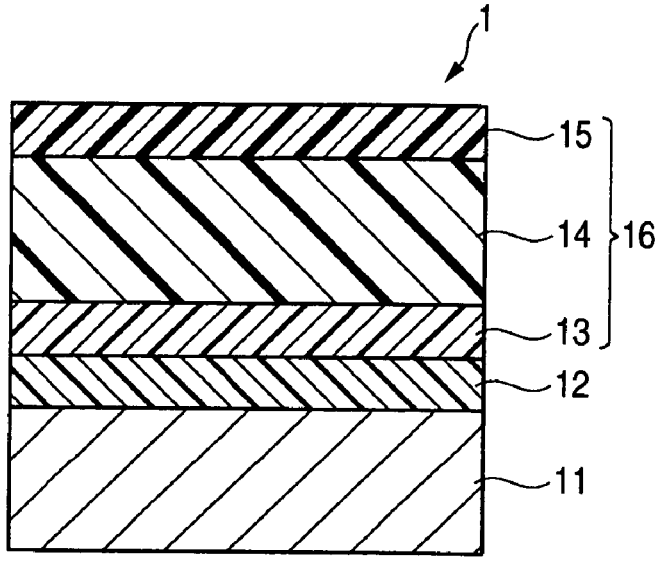
FIG. 1 is a schematic cross sectional view showing a preferred embodiment of an electrophotographic photoreceptor of the invention.

Preferred embodiments of the invention will be described in detail below with reference to drawings in some cases. In the drawings, the same reference numerals and signs are used to designate the same or corresponding parts, and repeated descriptions are avoided.

Electrophotographic Photoreceptor

In the electrophotographic photoreceptor of the invention, the photosensitive layer comprises a silicon compound-containing layer, and the silicon compound-containing layer further contains the resin.

The resin is preferably a resin soluble in a liquid component in a coating solution used for formation of this layer.

The resin soluble in the liquid component is appropriately selected depending on the kind of liquid component. For example, when the coating solution contains an alcoholic solvent (such as methanol, ethanol or butanol), a polyvinyl acetal resin such as a polyvinyl butyral resin, a polyvinyl formal resin or a partially acetalized polyvinyl acetal resin in which butyral is partially modified with formal or acetoacetal, a polyamide resin, a cellulose resin such as ethyl cellulose and a phenol resin are available as the alcohol-soluble resins. These resins may be used either alone or as a combination of two or more of them. Of the above-mentioned resins, the polyvinyl acetal resin is preferred in terms of electric characteristics.

The weight-average molecular weight of the resin soluble in the liquid component is preferably from 2,000 to 1,000,000, and more preferably from 5,000 to 50,000. When the average molecular weight is less than 2,000, the effect of enhancing discharge gas resistance, mechanical strength, scratch resistance, particle dispersibility, etc. tends to become insufficient. On the other hand, when the average molecular weight exceeds 1,000,000, the solubility of the resin in the coating solution decreases, thereby being liable to limit the amount thereof added and to contribute poor film formation in the production of the photosensitive layer.

Further, the amount of the resin soluble in the liquid component is preferably from 0.1 to 15% by weight, and more preferably from 0.5 to 10% by weight, based on the total amount of the coating solution. When the amount added is less than 0.1% by weight, the effect of enhancing discharge gas resistance, mechanical strength, scratch resistance, particle dispersibility, etc. tends to become insufficient. On the other hand, exceeding 15% by weight results in a tendency to cause an indistinct image when the electrophotographic photoreceptor of the invention is used at high temperature and high humidity.

There is no particular limitation on the silicon compound used in the invention, as long as it has at least one silicon atom. However, a compound having two or more silicon atoms in its molecule is preferably used. The use of the compound having two or more silicon atoms in its molecule allows both the strength and image quality of the electrophotographic photoreceptor to be achieved at higher levels.

In the invention, at least one member selected from silicon-containing compounds represented by the following general formulas (2) to (4) and hydrolysates or hydrolytic condensates thereof is preferably used.

$$W^1(\text{—}SiR_{3-a}Q_a)_2 \quad (2)$$

$$W^2(\text{-}D\text{-}SiR_{3-a}Q_a)_b \quad (3)$$

$$SiR_{4-c}Q_c \quad (4)$$

In general formulas (2) to (4), $W^1$ represents a divalent organic group, $W^2$ represents an organic group derived from a compound having hole transport capability, R represents a member selected from the group consisting of a hydrogen atom, an alkyl group and a substituted or unsubstituted aryl group, Q represents a hydrolytic group, D represents a divalent group, a represents an integer of 1 to 3, b represents an integer of 2 to 4, and c represents an integer of 1 to 4.

R in general formulas (2) to (4) represents a hydrogen atom, an alkyl group (preferably an alkyl group having 1 to 5 carbon atoms) or a substituted or unsubstituted aryl group (preferably a substituted or unsubstituted aryl group having 6 to 15 carbon atoms), as described above.

Further, the hydrolytic group represented by Q in general formulas (2) to (4) means a functional group which can form a siloxane bond (O—Si—O) by hydrolysis in the curing reaction of the compound represented by any one of general formulas (2) to (4). Preferred specific examples of the hydrolytic groups used in the invention include a hydroxyl group, an alkoxyl group, a methyl ethyl ketoxime group, a diethylamino group, an acetoxy group, a propenoxy group and a chloro group. Of these, a group represented by —OR" (R" represents an alkyl group having 1 to 15 carbon atoms or a trimethylsilyl group) is more preferred.

In general formula (3), the divalent group represented by D is preferably a divalent hydrocarbon group represented by $—C_nH_{2n}—$, $—C_nH_{2n-2}—$, $—C_nH_{2n-4}—$ (n is an integer of 1 to 15, and preferably an integer of 2 to 10), $—CH_2—C_6H_4—$ or $—C_6H_4—C_6H_4—$, an oxycarbonyl group (—COO—), a thio group (—S—), an oxy group (—O—), an isocyano group (—N═CH—) or a divalent group in which two or more of them are combined. The divalent group may have a substituent group such as an alkyl group, a phenyl group, an alkoxyl group or an amino group on its side chain. When D is the above-mentioned preferred divalent group, proper flexibility is imparted to an organic silicate skeleton, thereby tending to improve the strength of the layer.

Preferred examples of the compounds represented by the above-mentioned general formula (2) are shown in Table 1.

Further, in the above-mentioned general formula (3), there is no particular limitation on the organic group represented by $W^2$, as long as it is a group having hole transport capability. However, it is preferably an organic group represented by the following general formula (6):

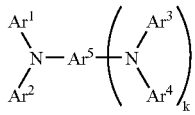

(6)

wherein $Ar^1$, $Ar^2$, $Ar^3$ and $Ar^4$, which may be the same or different, each represents a substituted or unsubstituted aryl group, $Ar^5$ represents a substituted or unsubstituted aryl or arylene group, k represents 0 or 1, and at least one of $Ar^1$ to $Ar^5$ has a bonding hand to connect with $-D-SiR_{3-a}Q_a$ in general formula (3).

TABLE 1

| No. | Structural Formula |
|---|---|
| III-1 | $(MeO)_3Si—(CH_2)_2—Si(OMe)_3$ |
| III-2 | $(MeO)_2Me—(CH_2)_2—SiMe(OMe)_2$ |
| III-3 | $(MeO)_2MeSi—(CH_2)_6—SiMe(OMe)_2$ |
| III-4 | $(MeO)_3Si—(CH_2)_6—Si(OMe)_3$ |
| III-5 | $(EtO)_3Si—(CH_2)_6—Si(OEt)_3$ |
| III-6 | $(MeO)_2MeSi—(CH_2)_{10}—SiMe(OMe)_2$ |
| III-7 | $(MeO)_3Si—(CH_2)_3—NH—(CH_2)_3—Si(OMe)_3$ |
| III-8 | $(MeO)_3Si—(CH2)_3—NH—(CH_2)_2—NH—(CH_2)_3—Si(OMe)_3$ |
| III-9 | 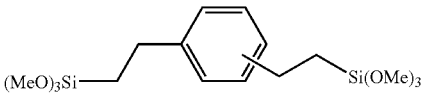 |
| III-10 | 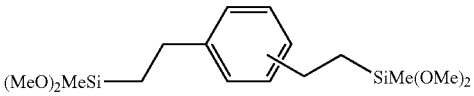 |
| III-11 | 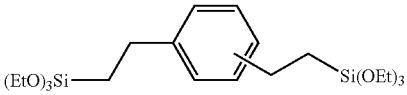 |
| III-12 | 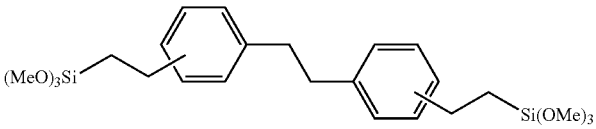 |
| III-13 | 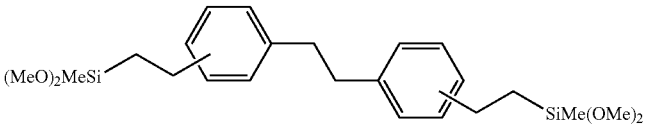 |
| III-14 | 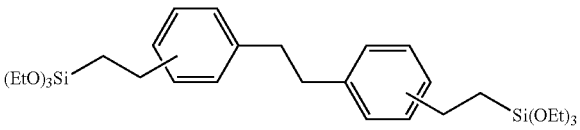 |
| III-15 | $(MeO)_3SiC_3H_6—O—CH_2CH\{—O—C_3H_6Si(OMe)_3\}—CH_2\{—O—C_3H_6Si(OMe)_3\}$ |
| III-16 | $(MeO)_3SiC_2H_4—SiMe_2—O—SiMe_2—O—SiMe_2—C_2H_4Si(OMe)_3$ |

$Ar^1$ to $Ar^4$ in the above-mentioned general formula (6) are each preferably any one of the following formulas (7) to (13):

(7)

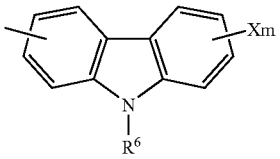

(8)

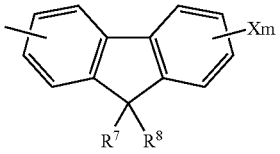

(9)

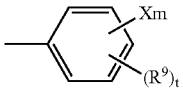

(10)

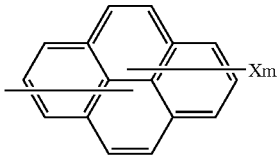

(11)

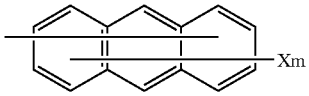

(12)

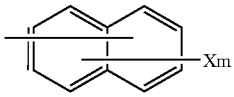

(13)

$$-Ar-Z'_5-Ar-X_m$$

In formulas (7) to (13), $R^6$ represents a member selected from the group consisting of a hydrogen atom, an alkyl group having 1 to 4 carbon atoms, an unsubstituted phenyl group or a phenyl group substituted by an alkyl group having 1 to 4 carbon atoms or an alkoxyl group having 1 to 4 carbon atoms, and an aralkyl group having 7 to 10 carbon atoms; $R^7$ to $R^9$ each represents a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; Ar represents a substituted or unsubstituted arylene group; X represents $-D-SiR_{3-a}Q_a$ in general formula (3); m and s each represents 0 or 1; q and r each represents an integer of 1 to 10; and t and t' each represents an integer of 1 to 3.

Here, Ar in formula (13) is preferably one represented by the following formula (14) or (15):

(14)

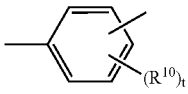

-continued (15)

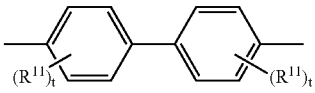

In formulas (14) and (15), $R^{10}$ and $R^{11}$ each represents a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; and t represents an integer of 1 to 3.

Further, Z' in formula (13) is preferably one represented by any one of the following formulas (16) to (23):

(16)

$$-(CH_2)_q-$$

(17)

$$-(CH_2CH_2O)_r-$$

(18)

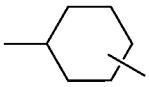

(19)

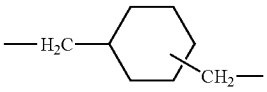

(20)

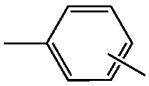

(21)

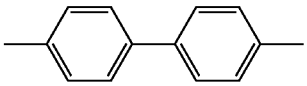

(22)

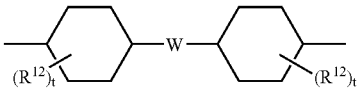

(23)

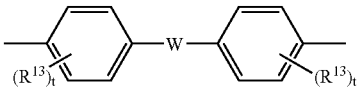

In formulas (16) to (23), $R^{12}$ and $R^{13}$ each represents a member selected from the group consisting of a hydrogen atom, an alkyl group having 1 to 4 carbon atoms, an alkoxyl group having 1 to 4 carbon atoms, an unsubstituted phenyl group or a phenyl group substituted by an alkoxyl group having 1 to 4 carbon atoms, an aralkyl group having 7 to 10 carbon atoms, and a halogen atom; W represents a divalent group; q and r each represents an integer of 1 to 10; and t represents an integer of 1 to 3.

W in the above-mentioned formulas (22) and (23) is preferably any one of divalent groups represented by the following formulas (24) to (32):

(24)

$$-CH_2-$$

(25)

$$-C(CH_3)_2-$$

-continued

(26) —O—

(27) —S—

(28) —$C(CF_3)_2$—

(29) —$Si(CH_3)_2$—

(30)

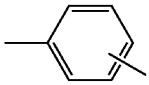

(31)

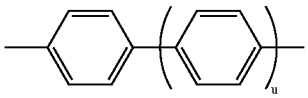

-continued (32)

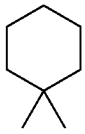

In formula (31), u represents an integer of 0 to 3.

Further, in general formula (6), $Ar^5$ is the aryl group illustrated in the description of $Ar^1$ to $Ar^4$, when k is 0, and an arylene group obtained by removing a certain hydrogen atom from such an aryl group, when k is 1.

Preferred combinations of $Ar^1$, $Ar^2$, $Ar^3$, $Ar^4$, $Ar^5$ and integer k in formula (6) and a group represented by -D-$SiR_{3-a}Q_a$ in general formula (3) are shown in Tables 2 to 5. In the tables, S represents -D-$SiR_{3-a}Q_a$ linked to $Ar^1$ to $Ar^5$, Me represents a methyl group, Et represents an ethyl group, and Pr represents a propyl group.

TABLE 2

| No. | $Ar^1$ | $Ar^2$ | $Ar^3$ | $Ar^4$ | $Ar^5$ | k | —S |
|---|---|---|---|---|---|---|---|
| V-1 | 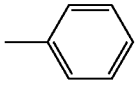 | 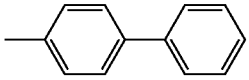 | — | — | 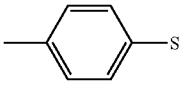 | 0 | —$(CH_2)_4$—$Si(OiPr)_3$ |
| V-2 | 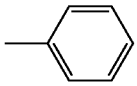 | 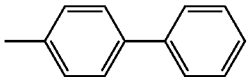 | — | — | 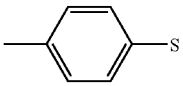 | 0 | —$(CH_2)_4$—$Si(OEt)_3$ |
| V-3 | 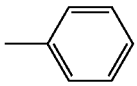 | 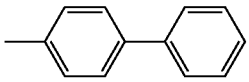 | — | — | 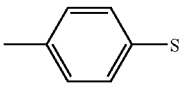 | 0 | —$(CH_2)_4$—$Si(OMe)_3$ |
| V-4 | 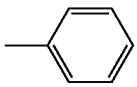 | 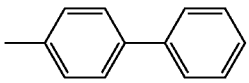 | — | — | 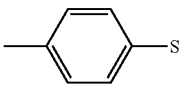 | 0 | —$(CH_2)_4$—$SiMe(OMe)_2$ |
| V-5 | 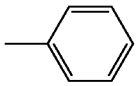 | 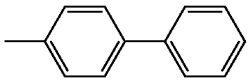 | — | — | 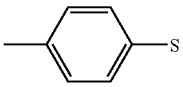 | 0 | —$(CH_2)_4$—$SiMe(OiPr)_2$ |
| V-6 | 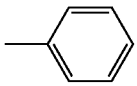 | 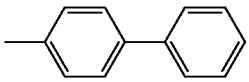 | — | — | 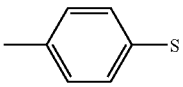 | 0 | —CH═CH—$(CH_2)_2$—$Si(OiPr)_3$ |
| V-7 | 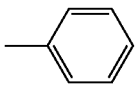 | 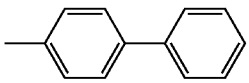 | — | — | 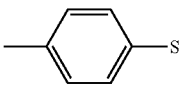 | 0 | —CH═CH—$(CH_2)_2$—$Si(OMe)_3$ |
| V-8 | 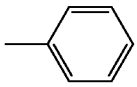 | 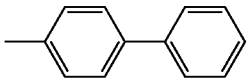 | — | — | 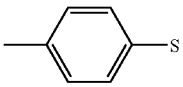 | 0 | —CH═N—$(CH_2)_3$—$Si(OiMe)_3$ |
| V-9 | 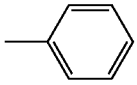 | 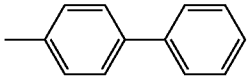 | — | — | 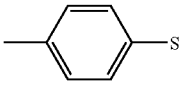 | 0 | —CH═N—$(CH_2)_3$—$Si(OiPr)_3$ |
| V-10 | 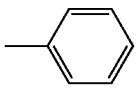 | 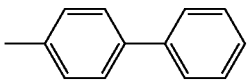 | — | — | 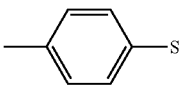 | 0 | —O—$(CH_2)_3$—$Si(OiPr)_3$ |

TABLE 2-continued

| No. | $Ar^1$ | $Ar^2$ | $Ar^3$ | $Ar^4$ | $Ar^5$ | k | —S |
|---|---|---|---|---|---|---|---|
| V-11 | | | — | — | S | 0 | —COO—$(CH_2)_3$—Si(OiPr)$_3$ |
| V-12 | | | — | — | S | 0 | —$(CH_2)_2$—COO—$(CH_2)_3$—Si(OiPr)$_3$ |
| V-13 | | | — | — | S | 0 | —$(CH_2)_2$—COO—$(CH_2)_3$—Si(OiPr)$_2$Me |
| V-14 | | | — | — | S | 0 | —$(CH_2)_2$—COO—$(CH_2)_3$—Si(OiPr)Me$_2$ |
| V-15 | Me, Me | | — | — | S | 0 | —$(CH_2)_4$—Si(OMe)$_3$ |

TABLE 3

| No. | $Ar^1$ | $Ar^2$ | $Ar^3$ | $Ar^4$ |
|---|---|---|---|---|
| V-16 | Me, Me | | — | — |
| V-17 | Me, Me | | — | — |
| V-18 | Me, Me | | — | — |
| V-19 | Me, Me | Me, Me | — | — |
| V-20 | Me, Me | N, Me | — | — |

TABLE 3-continued
| | | | | |
|---|---|---|---|---|
| V-21 | 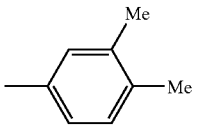 | 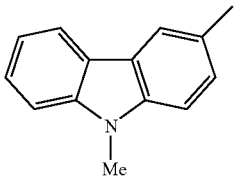 | — | — |
| V-22 | 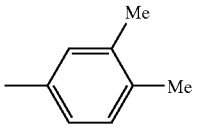 | 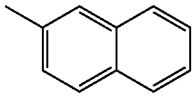 | — | — |
| V-23 | 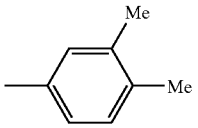 | 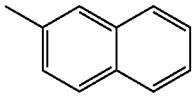 | — | — |
| V-24 | 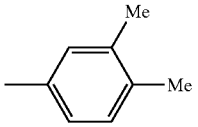 | 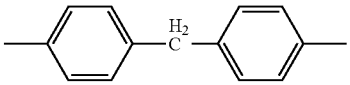 | — | — |
| V-25 | 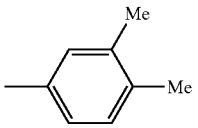 | 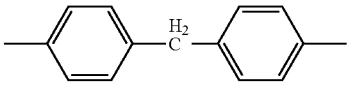 | — | — |
| V-26 | 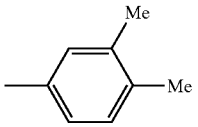 | 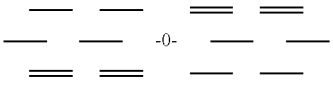 | — | — |
| V-27 | 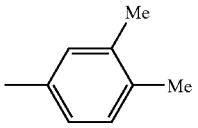 | 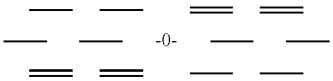 | — | — |
| V-28 | 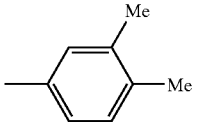 | 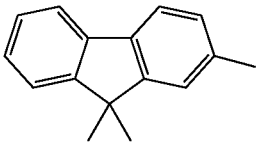 | — | — |
| V-29 | 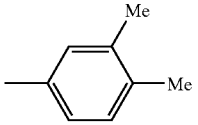 | 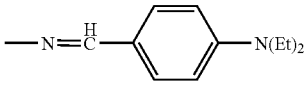 | — | — |
| V-30 | 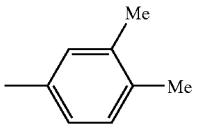 | 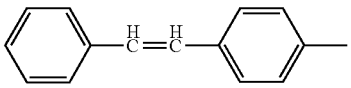 | — | — |

TABLE 3-continued
| No. | $Ar^5$ | k | —S |
|---|---|---|---|
| V-16 | 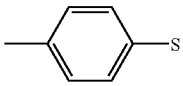 | 0 | —$(CH_2)_2$—COO—$(CH_2)_3$—Si(OiPr)$_3$ |
| V-17 | 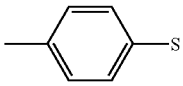 | 0 | —$(CH_2)_2$—COO—$(CH_2)_3$—SiMe(OiPr)$_2$ |
| V-18 | 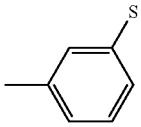 | 0 | —O—$(CH_2)_3$—Si(OiPr)$_3$ |
| V-19 | 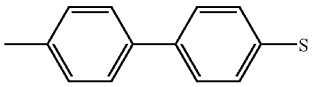 | 0 | —COO—$(CH_2)_3$—Si(OiPr)$_3$ |
| V-20 | 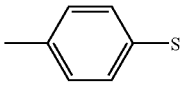 | 0 | —$(CH_2)_4$—Si(OiPr)$_3$ |
| V-21 | 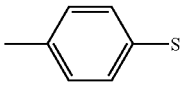 | 0 | —$(CH_2)_2$—COO—$(CH_2)_3$—Si(OiPr)$_3$ |
| V-22 | 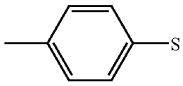 | 0 | —$(CH_2)_4$—Si(OiPr)$_3$ |
| V-23 | 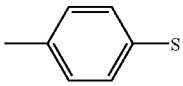 | 0 | —$(CH_2)_2$—COO—$(CH_2)_3$—Si(OiPr)$_3$ |
| V-24 | 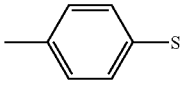 | 0 | —$(CH_2)_4$—Si(OiPr)$_3$ |
| V-25 | 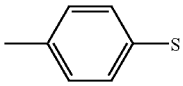 | 0 | —$(CH_2)_2$—COO—$(CH_2)_3$—Si(OiPr)$_3$ |
| V-26 | 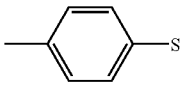 | 0 | —$(CH_2)_4$—Si(OiPr)$_3$ |
| V-27 | 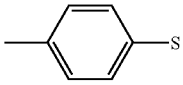 | 0 | —$(CH_2)_2$—COO—$(CH_2)_3$—Si(OiPr)$_3$ |
| V-28 | 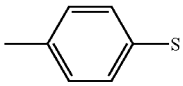 | 0 | —$(CH_2)_2$—COO—$(CH_2)_3$—Si(OiPr)$_3$ |
| V-29 | 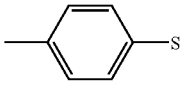 | 0 | —$(CH_2)_2$—COO—$(CH_2)_3$—Si(OiPr)$_3$ |
| V-30 | 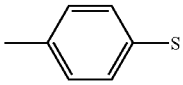 | 0 | —$(CH_2)_2$—COO—$(CH_2)_3$—Si(OiPr)$_3$ |

TABLE 4
| No. | $Ar^1$ | $Ar^2$ | $Ar^3$ |
|---|---|---|---|
| V-31 | 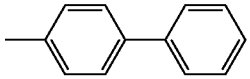 | 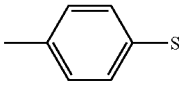 | — |
| V-32 | 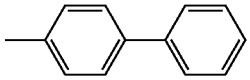 | 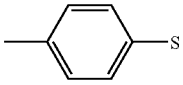 | — |
| V-33 | 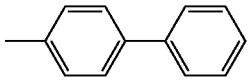 | 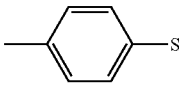 | — |
| V-34 | 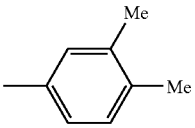 | 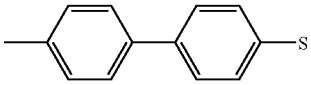 | — |
| V-35 | 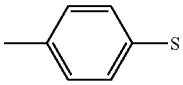 | 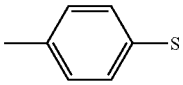 | — |
| V-36 | 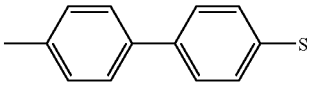 | 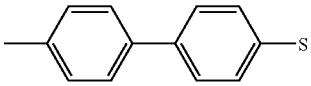 | — |
| V-37 | 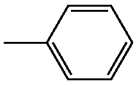 | 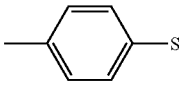 | 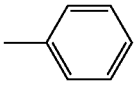 |
| V-38 | 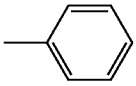 | 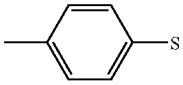 | 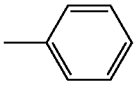 |
| V-39 | 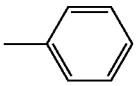 | 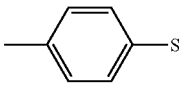 | 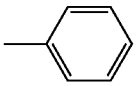 |
| V-40 | 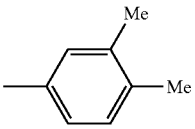 | 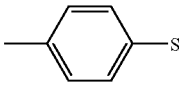 | 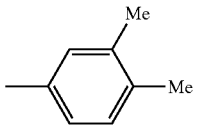 |
| V-41 | 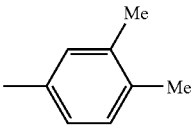 | 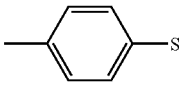 | 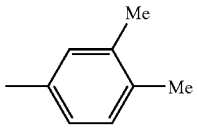 |
| V-42 | 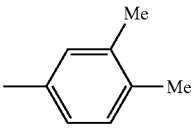 | 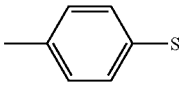 | 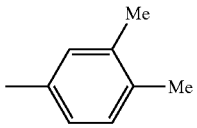 |
| V-43 | 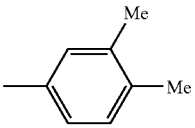 | 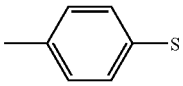 | 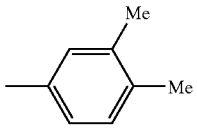 |

TABLE 4-continued
| | | | | |
|---|---|---|---|---|
| V-44 | 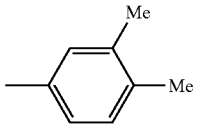 | 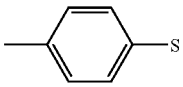 | 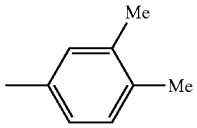 | |
| V-45 | 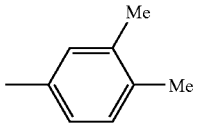 | 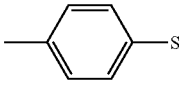 | 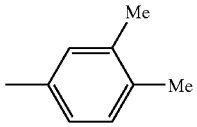 | |
| No. | $Ar^4$ | $Ar^5$ | k | —S |
| V-31 | — | 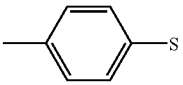 | 0 | $—(CH_2)_2—COO—(CH_2)_3—Si(OiPr)_3$ |
| V-32 | — | 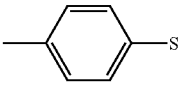 | 0 | $—(CH_2)_2—COO—(CH_2)_3—Si(OiPr)_2Me$ |
| V-33 | — | 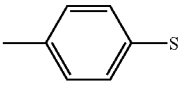 | 0 | $—(CH_2)_2—COO—(CH_2)_3—Si(OiPr)Me_2$ |
| V-34 | — | 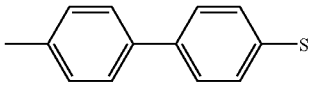 | 0 | $—COO—(CH_2)_3—Si(OiPr)_3$ |
| V-35 | — | 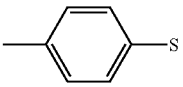 | 0 | $—(CH_2)_2—COO—(CH_2)_3—Si(OiPr)_3$ |
| V-36 | — | 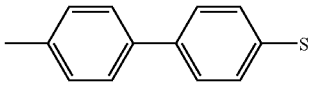 | 0 | $—COO—(CH_2)_3—Si(OiPr)_3$ |
| V-37 | 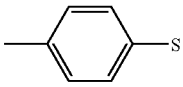 | 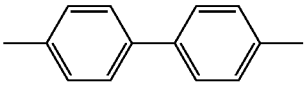 | 1 | $—(CH_2)_4—Si(OEt)_3$ |
| V-38 | 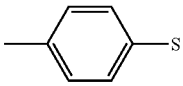 | 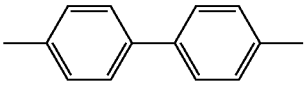 | 1 | $—(CH_2)_4—Si(OiPr)_3$ |
| V-39 | 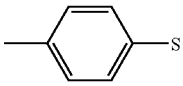 | 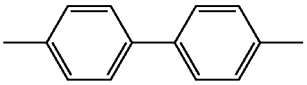 | 1 | $—CH=CH—(CH_2)_2—Si(OiPr)_3$ |
| V-40 | 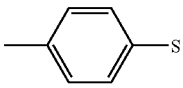 | 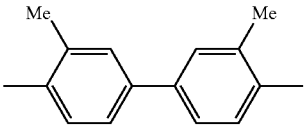 | 1 | $—(CH_2)_4—Si(OMe)_3$ |
| V-41 | 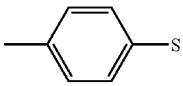 | 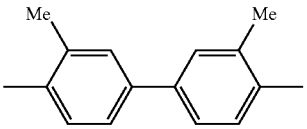 | 1 | $—(CH_2)_4—Si(OiPr)_3$ |

TABLE 4-continued
| | | | | |
|---|---|---|---|---|
| V-42 | 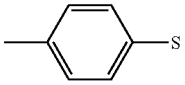 | 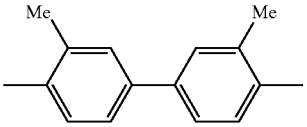 | 1 | —CH═CH—$(CH_2)_2$—Si(OiPr)$_3$ |
| V-43 | 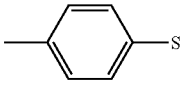 | 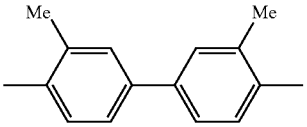 | 1 | —CH═N—$(CH_2)_3$—Si(OiPr)$_3$ |
| V-44 | 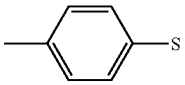 | 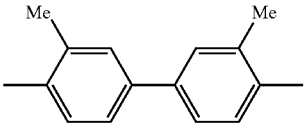 | 1 | —O—$(CH_2)_3$—Si(OiPr)$_3$ |
| V-45 | 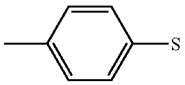 | 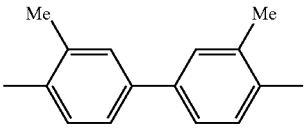 | 1 | —COO—$(CH_2)_3$—Si(OiPr)$_3$ |
TABLE 5
| No. | $Ar^1$ | $Ar^2$ | $Ar^3$ | $Ar^4$ |
|---|---|---|---|---|
| V-46 | 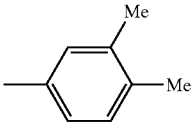 | 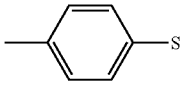 | 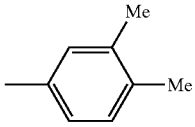 | 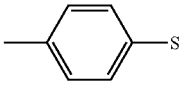 |
| V-47 | 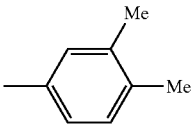 | 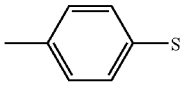 | 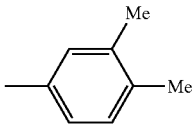 | 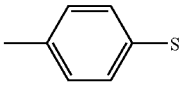 |
| V-48 | 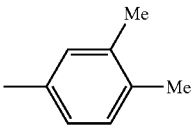 | 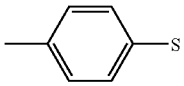 | 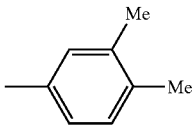 | 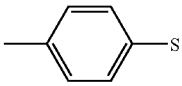 |
| V-49 | 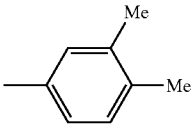 | 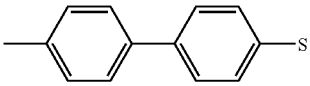 | 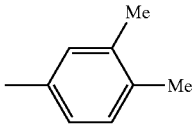 | 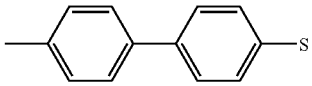 |
| V-50 | 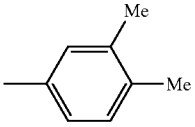 | 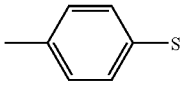 | 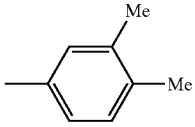 | 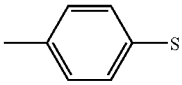 |
| V-51 | 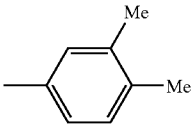 | 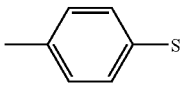 | 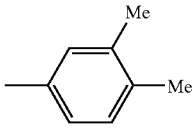 | 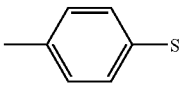 |

TABLE 5-continued
| | | | | |
|---|---|---|---|---|
| V-52 | 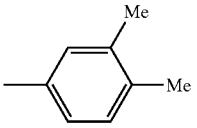 | 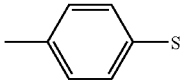 | 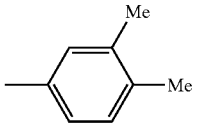 | 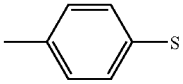 |
| V-53 | 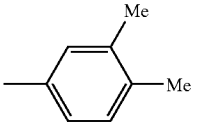 | 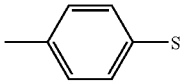 | 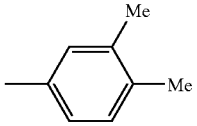 | 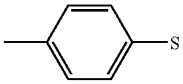 |
| V-54 | 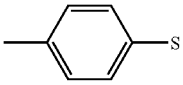 | 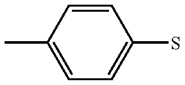 | 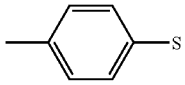 | 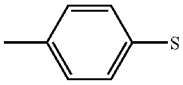 |
| V-55 | 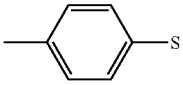 | 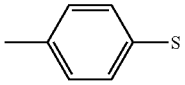 | 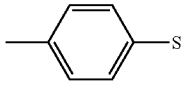 | 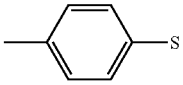 |
| V-56 | 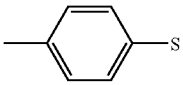 | 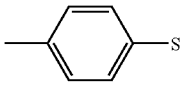 | 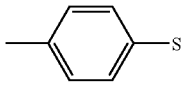 | 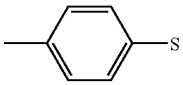 |
| V-57 | 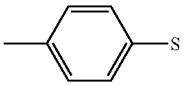 | 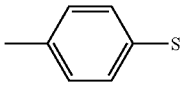 | 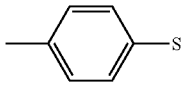 | 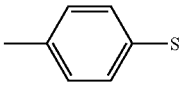 |
| V-58 | 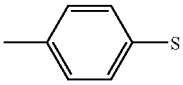 | 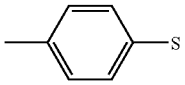 | 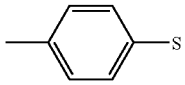 | 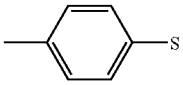 |
| V-59 | 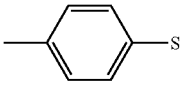 | 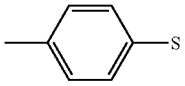 | 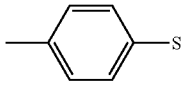 | 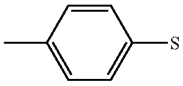 |
| V-60 | 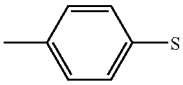 | 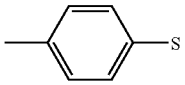 | 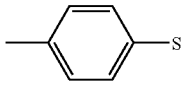 | 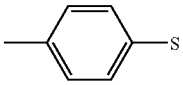 |
| V-61 | 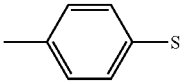 | 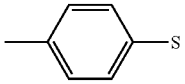 | 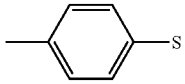 | 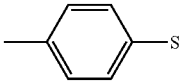 |
| No. | $Ar^5$ | k | —S |
|---|---|---|---|
| V-46 | 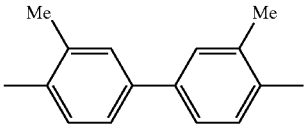 | 1 | $—(CH_2)_2—COO—(CH_2)_3—Si(OiPr)_3$ |
| V-47 | 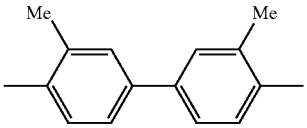 | 1 | $—(CH_2)_2—COO—(CH_2)_3—Si(OiPr)_2Me$ |
| V-48 | 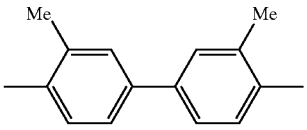 | 1 | $—(CH_2)_2—COO—(CH_2)_3—Si(OiPr)Me_2$ |

TABLE 5-continued
| | | | |
|---|---|---|---|
| V-49 | 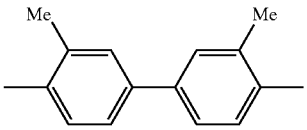 | 1 | —COO—$(CH_2)_3$—Si(OiPr)$_3$ |
| V-50 | 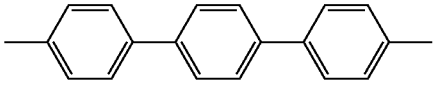 | 1 | —$(CH_2)_4$—Si(OiPr)$_3$ |
| V-51 | 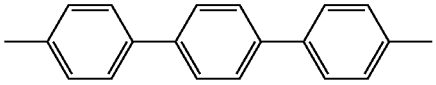 | 1 | —CH═CH—$(CH_2)_2$—Si(OiPr)$_3$ |
| V-52 | 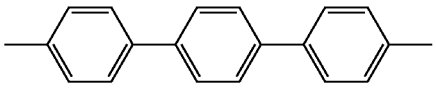 | 1 | —$(CH_2)_2$—COO—$(CH_2)_3$—Si(OiPr)$_3$ |
| V-53 | 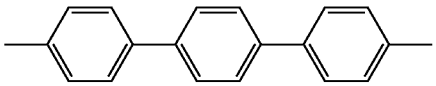 | 1 | —$(CH_2)_2$—COO—$(CH_2)_3$—Si(OiPr)$_2$Me |
| V-54 | 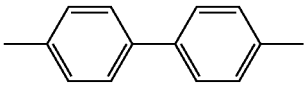 | 1 | —COO—$(CH_2)_3$—Si(OiPr)$_3$ |
| V-55 | 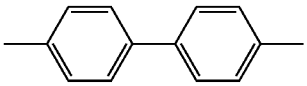 | 1 | —$(CH_2)_2$—COO—$(CH_2)_3$—Si(OiPr)$_2$ |
| V-56 | 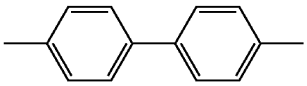 | 1 | —$(CH_2)_2$—COO—$(CH_2)_3$—Si(OiPr)$_2$Me |
| V-57 | 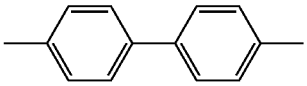 | 1 | —$(CH_2)_2$—COO—$(CH_2)_3$—Si(OiPr)Me$_2$ |
| V-58 | 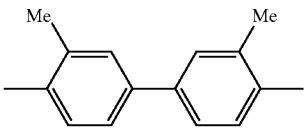 | 1 | —COO—$(CH_2)_3$—Si(OiPr)$_3$ |
| V-59 | 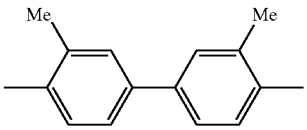 | 1 | —$(CH_2)_2$—COO—$(CH_2)_3$—Si(OiPr)$_3$ |
| V-60 | 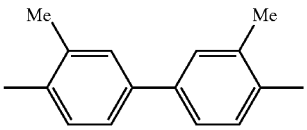 | 1 | —$(CH_2)_2$—COO—$(CH_2)_3$—Si(OiPr)$_2$Me |
| V-61 | 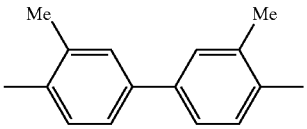 | 1 | —$(CH_2)_2$—COO—$(CH_2)_3$—Si(OiPr)Me$_2$ |

Further, the silicon compounds represented by the above-mentioned general formula (4) include silane coupling agents such as a tetrafunctional alkoxysilane (c=4) such as tetramethoxysilane or tetraethoxysilane; a trifunctional alkoxysilane (c=3) such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltriethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane or 1H,1H,2H,2H-perfluorooctyltriethoxysilane; a bifunctional alkoxysilane (c=2) such as dimethyldimethoxysilane, diphenyldimethoxysilane or methylphenyldimethoxysilane; and a monofunctional alkoxysilane (c=1) such as trimethylmethoxysilane.

In order to improve the strength of the photosensitive layer, the trifunctional alkoxysilanes and the tetrafunctional alkoxysilanes are preferred, and in order to improve the flexibility and film forming properties, the monofunctional alkoxysilanes and the bifunctional alkoxysilanes are preferred.

Silicone hard coating agents containing these coupling agents can also be used. Commercially available hard coating agents include KP-85, X-40-9740 and X-40-2239 (the above are manufactured by Shinetsu Silicone Co., Ltd.), and AY42-440, AY42-441 and AY49-208 (the above are manufactured by Toray Dow Corning Co., Ltd.).

The silicon compound-containing layer may contain either only one of the silicon compounds represented by the above-mentioned general formulas (2) to (4) or two or more of them. Further, the compounds represented by general formulas (2) to (4) include a monofunctional compound (a compound in which a or c is 1), a bifunctional compound (a compound in which a or c is 2), a trifunctional compound (a compound in which a or c is 3) and a tetrafunctional compound (a compound in which a or c is 4). However, it is preferred that the number of silicon atoms derived from the silicon-containing compounds represented by the above-mentioned general formulas (2) to (4) in the silicon compound-containing layer satisfies a requirement represented by the following equation (5):

$$(N_{a=3}+N_{c\geqq 3})/N_{total}\leqq 0.5 \quad (5)$$

wherein $N_{a=3}$ represents the number of silicon atoms derived from $—SiR_{3-a}Q_a$ of the silicon compound represented by general formula (2) or (3) in which a is 3, $N_{c\geqq 3}$ represents the number of silicon atoms derived from the silicon compound represented by general formula (4) in which c is 3 or 4, and $N_{total}$ represents the total of the number of silicon atoms derived from $—SiR_{3-a}Q_a$ of the silicon compound represented by general formula (2) or (3) and the number of silicon atoms derived from the silicon compound represented by general formula (4). That is to say, the ratio of the silicon compounds contained is preferably set so that the number of silicon atoms derived from the trifunctional compound or the tetrafunctional compound becomes 0.5 or less based on the number of silicon atoms derived from the silicon-containing compounds represented by general formulas (2) to (4) (in the case of the compound represented by general formula (2) or (3), the silicon atoms are limited to ones derived from $—SiR_{3-a}Q_a$, and the same applies hereinafter). When the value of the left side of equation (5) exceeds 0.5, an indistinct image tends to be liable to occur at high temperature and high humidity. When the value of the left side of equation (5) is decreased, there is the possibility that it causes a decrease in strength. However, the use of the compound having two or more silicon atoms in its molecule can improve the strength.

In order to further improve the stain adhesion resistance and lubricity of the electrophotographic photoreceptor, various fine particles can also be added to the silicon compound-containing layer. The fine particles may be used either alone or as a combination of two or more of them. Examples of the fine particles include fine particles containing silicon. The fine particles containing silicon are fine particles containing silicon as a constituent element, and specifically include colloidal silica and fine silicone particles.

Colloidal silica used as the fine particles containing silicon in the invention is selected from an acidic or alkaline aqueous dispersion of the fine particles having an average particle size of 1 to 100 nm, preferably 10 to 30 nm, and a dispersion of the fine particles in an organic solvent such as an alcohol, a ketone or an ester, and generally, commercially available particles can be used.

There is no particular limitation on the solid content of colloidal silica in a top surface layer of the electrophotographic photoreceptor of the invention. However, colloidal silica is used within the range of 1 to 50% by weight, preferably within the range of 5 to 30% by weight, based on the total solid content of the top surface layer, in terms of film forming properties, electric characteristics and strength.

The fine silicone particles used as the fine particles containing silicon in the invention are selected from silicone resin particles, silicone rubber particles and silica particles surface-treated with silicone, which are spherical and have an average particle size of preferably 1 to 500 nm and more preferably 10 to 100 nm, and generally, commercially available particles can be used.

The fine silicone particles are small-sized particles which are chemically inactive and excellent in dispersibility in a resin, and further low in the content necessary for obtaining sufficient characteristics. Accordingly, the surface properties of the electrophotographic photoreceptor can be improved without inhibition of the crosslinking reaction. That is to say, the fine silicone particles improve the lubricity and water repellency of a surface of the electrophotographic photoreceptor in a state where they are incorporated into a strong crosslinked structure, thereby being able to maintain good wear resistance and stain adhesion resistance for a long period of time. The content of the fine silicone particles in the silicon compound-containing layer is within the range of 0.1 to 20% by weight, and preferably within the range of 0.5 to 10% by weight, based on the total solid content of the silicon compound-containing layer.

Other fine particles include fine fluorine-based particles such as ethylene tetrafluoride, ethylene trifluoride, propylene hexafluoride, vinyl fluoride and vinylidene fluoride, and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

In the conventional electrophotographic photoreceptor, when the above-mentioned fine particles are contained in the photosensitive layer, the compatibility of the fine particles with a charge transfer substance or a binding resin is liable to become insufficient, which causes layer separation in the photosensitive layer to form an opaque film. As a result, the electric characteristics have deteriorated in some cases. In contrast, according to the invention, the silicon compound-containing layer (a charge transfer layer in this case) is allowed to contain the resin soluble in the liquid component in the coating solution used for formation of this layer and the silicon compound, thereby improving the dispersibility of the fine particles in the silicon compound-containing layer. Accordingly, the pot life of the coating solution can be sufficiently prolonged, and it becomes possible to prevent deterioration of the electric characteristics.

Further, an additive such as a plasticizer, a surface modifier, an antioxidant or an agent for preventing deterioration by light can also be used in the silicon compound-containing layer. The plasticizers include, for example, biphenyl, biphenyl chloride, terphenyl, dibutyl phthalate, diethylene glycol phthalate, dioctyl phthalate, triphenylphosphoric acid, methylnaphthalene, benzophenone, chlorinated paraffin, polypropylene, polystyrene and various fluorohydrocarbons.

The antioxidants include an antioxidant having a hindered phenol, hindered amine, thioether or phosphite partial structure. This is effective for improvement of potential stability and image quality in environmental variation. For example, the hindered phenol antioxidants include Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM and Sumilizer GS (the above are manufactured by Sumitomo Chemical Co., Ltd.), IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WLj, IRGANOX 1520Lj, IRGANOX 245, IRGANOX 259, IRGANOX 3114, IRGANOX 3790, IRGANOX 5057 and IRGANOX 565 (the above are manufactured by Ciba Specialty Chemicals), and Adecastab AO-20, Adecastab AO-30, Adecastab AO-40, Adecastab AO-50, Adecastab AO-60, Adecastab AO-70, Adecastab AO-80 and Adecastab AO-330i (the above are manufactured by Asahi Denka Co., Ltd.). The hindered amine antioxidants include Sanol LS2626, Sanol LS765, Sanol LS770, Sanol LS744, Tinuvin 144, Tinuvin 622LD, Mark LA57, Mark LA67, Mark LA62, Mark LA68, Mark LA63 and Sumilizer TPS, and the phosphite antioxidants include Mark 2112, Mark PEP•8, Mark PEP•24G, Mark PEP•36, Mark 329K and Mark HP•10. Of these, the hindered phenol and hindered amine antioxidants are particularly preferred.

In the invention, the photosensitive layer is constituted, containing the silicon compound-containing layer having the above-mentioned constitution. It is necessary that a peak area in the region of −40 to 0 ppm ($S_1$) and a peak area in the region of −100 to −50 ppm ($S_2$) of the photosensitive layer in a $^{29}$Si-NMR spectrum satisfy the following equation (1):

$$S_1/(S_1+S_2) \geqq 0.5 \quad (1).$$

When $S_1/(S_1+S_2)$ is less than 0.5, defects such as a tendency to cause an indistinct image at high temperature and the pot life shortened are liable to occur. For a similar reason, $S_1/(S_1+S_2)$ is preferably 0.6 or more, and more preferably 0.7 or more.

The $^{29}$Si-NMR spectrum of the photosensitive layer can be measured through the following procedure. First, the photosensitive layer is separated from the electrophotographic photoreceptor by use of a silicon-free adhesive tape, and a sample tube (7 mm in diameter) made of zirconia is filled with 150 mg of the resulting separated product. The sample tube is set on a $^{29}$Si-NMR spectral measuring apparatus (for example, UNITY-300 manufactured by Varian, Inc.), and measurements are made under the following conditions:

Frequency: 59.59 MHz
Delay time: 10.00 seconds
Contact time: 2.5 milliseconds
Measuring temperature: 25° C.
Integrating number: 10,000 times
Revolution: 4,000±500 rpm The electrophotographic photoreceptor of the invention may be either a function separation type photoreceptor in which a layer containing a charge generation substance (charge generation layer) and a layer containing a charge transfer substance (charge transfer layer) are separately provided or a monolayer type photoreceptor in which both the charge generation layer and the charge transfer layer are contained in the same layer, as long as it has the photosensitive layer provided with the above-mentioned silicon compound-containing layer. However, the function separation type photoreceptor is preferred. The electrophotographic photoreceptor of the invention will be described in greater detail below, taking the function separation type photoreceptor as an example.

FIG. 1 is a cross sectional view schematically showing a preferred embodiment of the electrophotographic photoreceptor of the invention. The electrophotographic photoreceptor 1 shown in FIG. 1 is a function separation type photoreceptor in which a charge generation layer 13 and a charge transfer layer 14 are separately provided. That is to say, an underlayer 12, the charge generation layer 13, the charge transfer layer 14 and a protective layer 15 are laminated in this order on a conductive support 11 to form a photosensitive layer 16. Of these, the protective layer 15 contains the resin soluble in the liquid component contained in the coating solution used for formation of this layer and the silicon compound. Further, a peak area in the region of −40 to 0 ppm and a peak area in the region of −100 to −50 ppm in a $^{29}$Si-NMR spectrum of the photosensitive layer 16 satisfy the above-mentioned equation (1).

The conductive support 11 includes, for example, a metal plate, a metal drum or a metal belt using a metal such as aluminum, copper, zinc, stainless steel, chromium, nickel, molybdenum, vanadium, indium, gold or a platinum, or an alloy thereof; and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

Binding resins used in the underlayer 12 include, specifically, a polyamide resin, a vinyl chloride resin, a vinyl acetate resin, a phenol resin, a polyurethane resin, a melamine resin, a benzoguanamine resin, a polyimide resin, a polyethylene resin, a polypropylene resin, a polycarbonate resin, an acrylic resin, a methacrylic resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, polyacrylic acid, polyacrylamide, a zirconium chelate compound, a titanyl chelate compound, a titanyl alkoxide compound, an organic titanyl compound and a silane coupling agent. These can be used either alone or as a combination of two or more of them. Further, fine particles of titanium oxide, aluminum oxide, silicon oxide, zirconium oxide, barium titanate, a silicone resin or the like may be added to the above-mentioned binding resin.

As a coating method in forming the underlayer, an ordinary method such as blade coating, Mayer bar coating, spray coating, dip coating, bead coating, air knife coating or curtain coating is employed. The thickness of the underlayer is suitably from 0.01 to 40 μm.

The charge generation substances contained in the charge generation layer 13 include, for example, various organic pigments and organic dyes such as an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide. Of these, the cyclocondensed aromatic pigments, the perylene pigment and the azo pigment are preferred in terms of sensitivity, electric stability and photochemical stability against irradiated light. These charge generation substances may be used either alone or as a combination of two or more of them.

The charge generation layer 13 is formable by vacuum deposition of the charge generation substance or application of a coating solution in which the charge generation substance is dispersed in an organic solvent containing a binding resin. The binding resins used in the charge generation layer include a polyvinyl acetal resin such as a polyvinyl butyral resin, a polyvinyl formal resin or a partially acetalized polyvinyl acetal resin in which butyral is partially modified with formal or acetoacetal, a polyamide resin, a polyester resin, a modified ether type polyester resin, a polycarbonate resin, an acrylic resin, a polyvinyl chloride resin, a polyvinylidene chloride, a polystyrene resin, a polyvinyl acetate resin, a vinyl chloride-vinyl acetate copolymer, a silicone resin, a phenol resin, a phenoxy resin, a melamine resin, a benzoguanamine resin, a urea resin, a polyurethane resin, a poly-N-vinylcarbazole resin, a polyvinylanthracene resin and a polyvinylpyrene resin. These can be used either alone or as a combination of two or more of them. Of these, when the polyvinyl acetal resin, the vinyl chloride-vinyl acetate copolymer, the phenoxy resin or the modified ether type polyester resin is used, the dispersibility of the charge generation substance is improved to cause no occurrence of coagulation of the charge generation substance, thereby obtaining the coating solution stable for a long period of time. The use of such a coating solution makes it possible to form a uniform coating easily and surely. As a result, the electric characteristics are improved, thereby being able to sufficiently prevent the occurrence of an image defect. Further, the compounding ratio of the charge generation substance to the binding resin is preferably within the range of 5:1 to 1:2 by volume ratio.

Further, the solvents used in preparing the coating solution include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform. These can be used either alone or as a mixture of two or more of them.

Methods for applying the coating solution include the coating methods exemplified in the description of the above-mentioned underlayer. The thickness of the charge generation layer 13 thus formed is preferably from 0.01 to μm, and more preferably from 0.1 to 2 μm. When the thickness of the charge generation layer 13 is less than 0.01 μm, it becomes difficult to uniformly form the charge generation layer. On the other hand, when the thickness exceeds 5 μm, the electrophotographic characteristics tend to significantly deteriorate.

Further, a stabilizer such as an antioxidant or an inactivating agent can also be added to the charge generation layer 13. The antioxidants include, for example, antioxidants such as phenolic, sulfur, phosphorus and amine compounds. The inactivating agents include bis(dithiobenzyl)nickel and nickel di-n-butylthiocarbamate.

The charge transfer layer 14 can be formed by applying a coating solution containing the charge transfer substance and a binding resin, and further fine particles, an additive, etc., as described above.

The low molecular weight charge transfer substances include, for example, pyrene, carbazole, hydrazone, oxazole, oxadiazole, pyrazoline, arylamine, arylmethane, benzidine, thiazole, stilbene and butadiene compounds. Further, the high molecular weight charge transfer substances include, for example, poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane. Of these, the triphenylamine compound, the triphenylmethane compound and the benzidine compound are preferred in terms of mobility, stability and transparency to light. Further, the silicon compound represented by the above-mentioned general formula (2) can also be used as the charge transfer substance.

As the binding resin, a high molecular weight polymer which can form an electrical insulating film is preferred. For example, when the polyvinyl acetal resin, the polyamide resin, the cellulose resin, the phenol resin, etc., which are the resins soluble in the alcoholic solvents, are used, the binding resins used together with these resins include a polycarbonate, a polyester, a methacrylic resin, an acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, vinyl chloride-vinyl acetate-maleic anhydride copolymer, a silicone resin, a silicone-alkyd resin, a phenol-formaldehyde resin, a styrene-alkyd resin, poly-N-vinylcarbazole, polyvinyl butyral, polyvinyl formal, a polysulfone, casein, gelatin, polyvinyl alcohol, a phenol resin, a polyamide, carboxymethyl cellulose, a vinylidene chloride-based polymer latex and a polyurethane. Of the above-mentioned high molecular weight polymers, the polycarbonate, the polyester, the methacrylic resin and the acrylic resin are preferred, because they are excellent in compatibility with the charge transfer substance, solubility in the solvent and strength.

The charge transfer layer 14 may further contain an additive such as a plasticizer, a surface modifier, an antioxidant or an agent for preventing deterioration by light.

The thickness of the charge transfer layer 14 is preferably from 5 to 50 μm, and more preferably from 10 to 40 μm. When the thickness of the charge transfer layer is less than 5 μm, it becomes difficult to be charged. On the other hand, exceeding 50 μm results in a tendency to significantly deteriorate the electrophotographic characteristics.

The protective layer 15 contains the resin soluble in the liquid component in the coating solution used for formation of the protective layer and the silicon compound as described above. The protective layer 15 may further contain a lubricant or fine particles of a silicone oil or a fluorine material, which can also improve lubricity and strength. Preferred examples of the lubricants include the above-mentioned fluorine-based silane coupling agents. The fine particles to be dispersed include fine particles comprising a resin obtained by copolymerizing a fluororesin with a hydroxyl group-containing monomer, which is described in *Proceedings of Lectures in the Eighth Polymer Material Forum,* page 89, and a semiconductive metal oxide, as well as the above-mentioned fine silicone particles and fine fluorine-based particles. The thickness of the protective layer is preferably from 0.1 to 10 μm, and more preferably from 0.5 to 7 μm.

The electrophotographic photoreceptor of the invention should not be construed as being limited to the abovementioned constitution. For example, the electrophotographic photoreceptor shown in FIG. 1 is provided with the protective layer 15. However, when the charge transfer layer 14 contains the resin soluble in the liquid component in the coating solution used for formation of this layer and the silicon compound, the charge transfer layer 14 may be used as a top surface layer (a layer on the side farthest apart from the support 11) without using the protective layer 15. In this case, the charge transfer substance contained in the charge transfer layer 14 is preferably soluble in the liquid component in the coating solution used for formation of the charge transfer layer 14. for example, when the coating solution used for formation of the charge transfer layer 14 contains the alcoholic solvent, the silicon compounds represented by the above-mentioned general formula (2) and compounds represented by the following formulas (VI-1) to (VI-16) are preferably used as the charge transfer substances.

(VI-1)

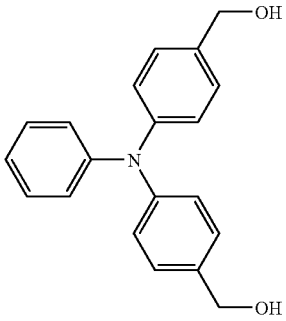

(VI-2)

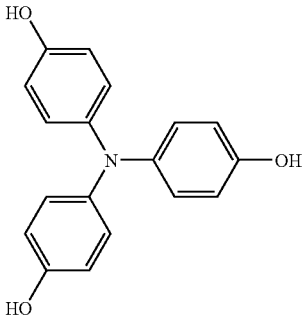

-continued (VI-3)

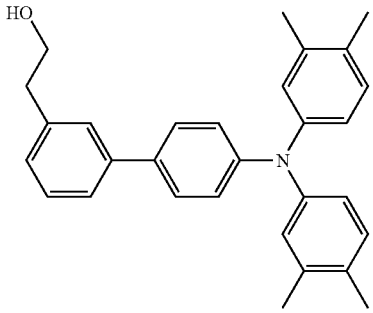

(VI-4)

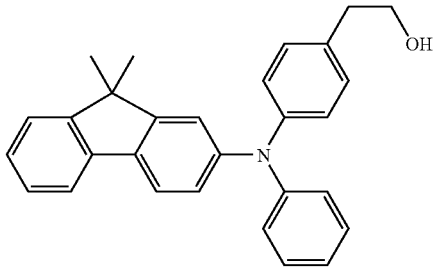

(VI-5)

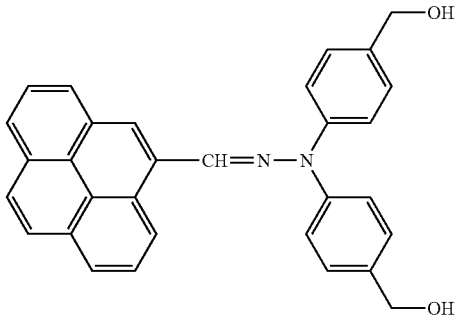

(VI-6)

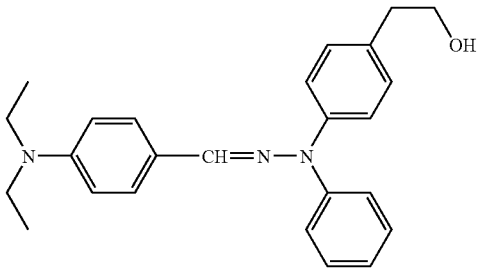

(VI-7)

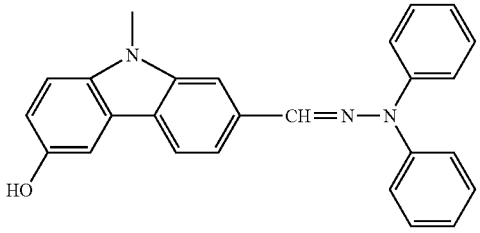

Figure 2:
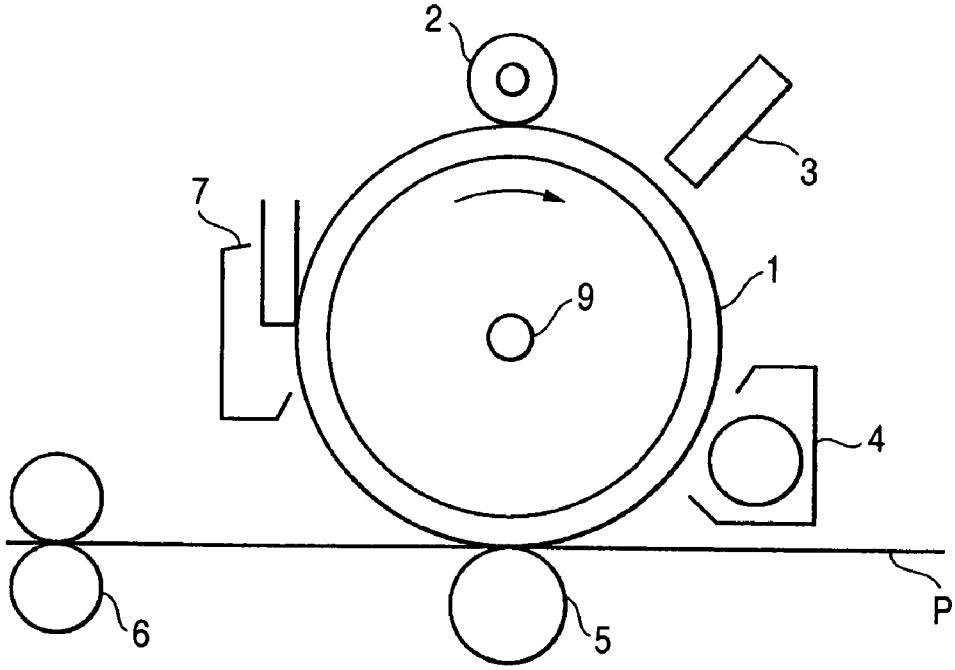
FIG. 2 is a schematic view showing a preferred embodiment of an image forming apparatus of the invention.

-continued
(VI-8)
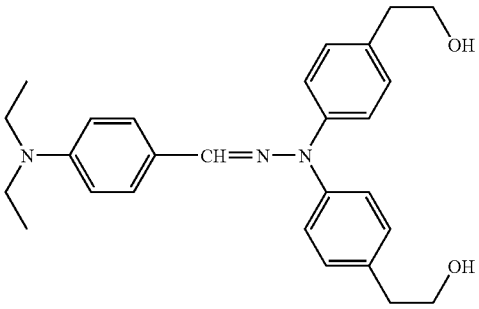
VI-9
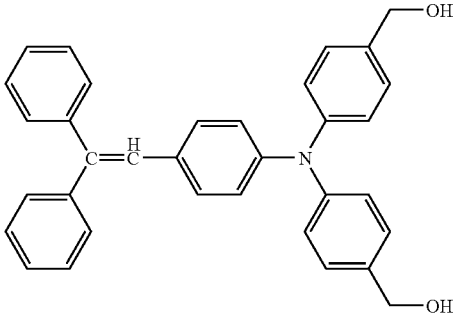
VI-10
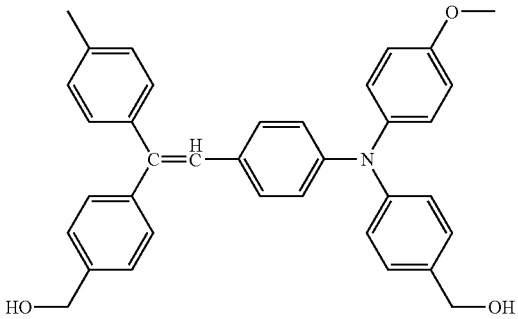
VI-11
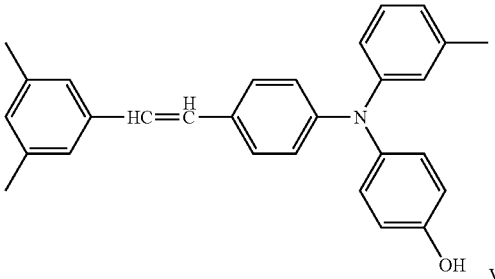
VI-12
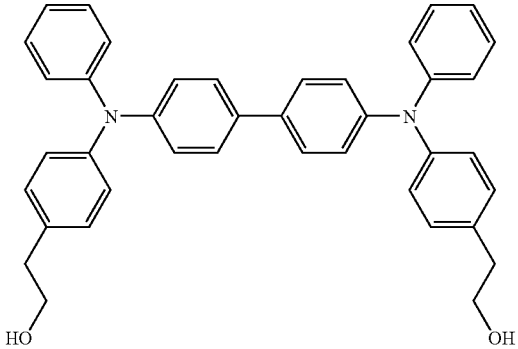
-continued
VI-13
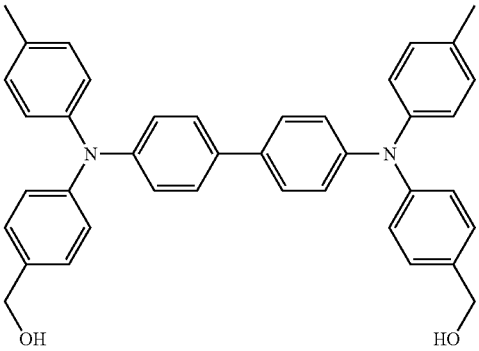
VI-14
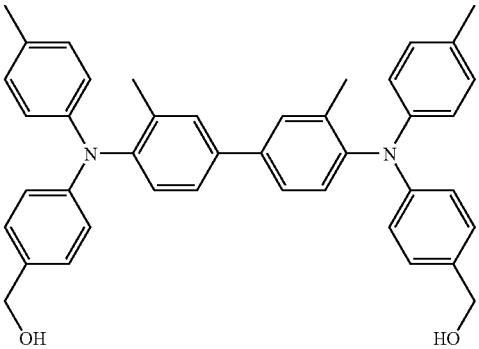
(VI-15)
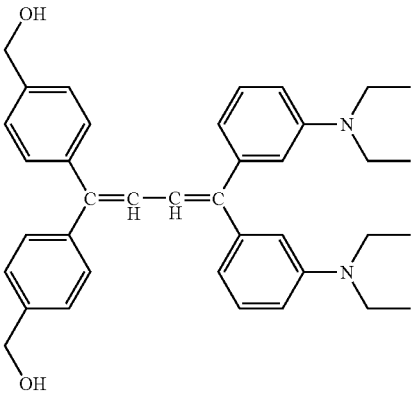
(VI-16)
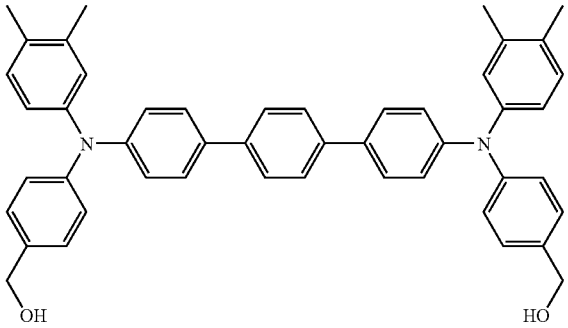
Image Forming Apparatus and Process Cartridge
FIG. 2 is a schematic view showing a preferred embodiment of the image forming apparatus of the invention. In the apparatus shown in FIG. 2, the electrophotographic photoreceptor 1 constituted as shown in FIG. 1 is supported by a support 9, and rotatable at a specified rotational speed in the direction indicated by the arrow, centered on the support 9. A contact charging device 2, an exposure device 3, a developing device 4, a transfer device 5 and a cleaning unit 7 are arranged in this order along the rotational direction of the electrophotographic photoreceptor 1. Further, this apparatus is equipped with an image fixing device 6, and a medium P to which a toner image is to be transferred is conveyed to the image fixing device 6 through the transfer device 5.

The contact charging device 2 has a roller-shaped contact charging member. The contact charging member is arranged so that it comes into contact with a surface of the photoreceptor 1, and a voltage is applied, thereby being able to give a specified potential to the surface of the photoreceptor 1. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

Further, a covering layer can also be provided on a surface of the contact charging member. Materials for forming this covering layer include N-alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

The resistance of the contact charging member is preferably from $10^0$ to $10^{14}$ Ωcm, and more preferably from $10^2$ to $10^{12}$ Ωcm. When a voltage is applied to this contact charging member, either a DC voltage or an AC voltage can be used as the applied voltage. Further, a superimposed voltage of a DC voltage and an AC voltage can also be used.

In the apparatus shown in FIG. 2, the contact charging member of the contact charging device 2 is in the shape of a roller. However, such a contact charging member may be in the shape of a blade, a belt, a brush or the like.

Further, as the exposure device 3, there can be used an optical device which can perform desired imagewise exposure to a surface of the electrophotographic photoreceptor 1 with a light source such as a semiconductor laser, an LED (light emitting diode) or a liquid crystal shutter. Of these, the use of the exposure device which makes it possible to perform exposure to noninterference light can prevent interference fringes between the support (substrate) of the electrophotographic photoreceptor 1 and the photosensitive layer.

Furthermore, as the developing device 4, there can be used a known developing device using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

As the transfer device 5, there can be used a contact type transfer charging device using a belt, a roller, a film, a rubber blade or the like, or a scorotron transfer charger or a corotron transfer charger utilizing corona discharge.

Further, the cleaning device 7 is a device for removing a remaining toner adhered to the surface of the electrophotographic photoreceptor 1 after a transfer step, and the electrophotographic photoreceptor 1 cleaned up thereby is repeatedly subjected to the above-mentioned image formation process. As the cleaning device 7, there can be used a cleaning blade, a cleaning brush, a cleaning roll or the like. Of these, the cleaning blade is preferably used. Materials for the cleaning blade include urethane rubber, neoprene rubber and silicone rubber.

In the image forming device shown in FIG. 2, the respective steps of charging, exposure, development, transfer and cleaning are conducted in turn in the rotation step of the electrophotographic photoreceptor 1, thereby repeatedly performing image formation. Here, the electrophotographic photoreceptor 1 is provided with the specified silicon compound-containing layer and the photosensitive layer satisfying the requirement represented by equation (1) in the $^{29}$Si-NMR spectrum, as described above, so that the photoreceptor is excellent in discharge gas resistance, mechanical strength, scratch resistance, particle dispersibility, etc. Accordingly, even when the photoreceptor is used together with the contact charging device or the cleaning blade, or further with the spherical toner obtained by chemical polymerization, good image quality can be obtained without the occurrence of image defects such as fogging. According to this embodiment, therefore, the image forming apparatus which can stably provide good image quality for a long period of time is realized.

Figure 3:
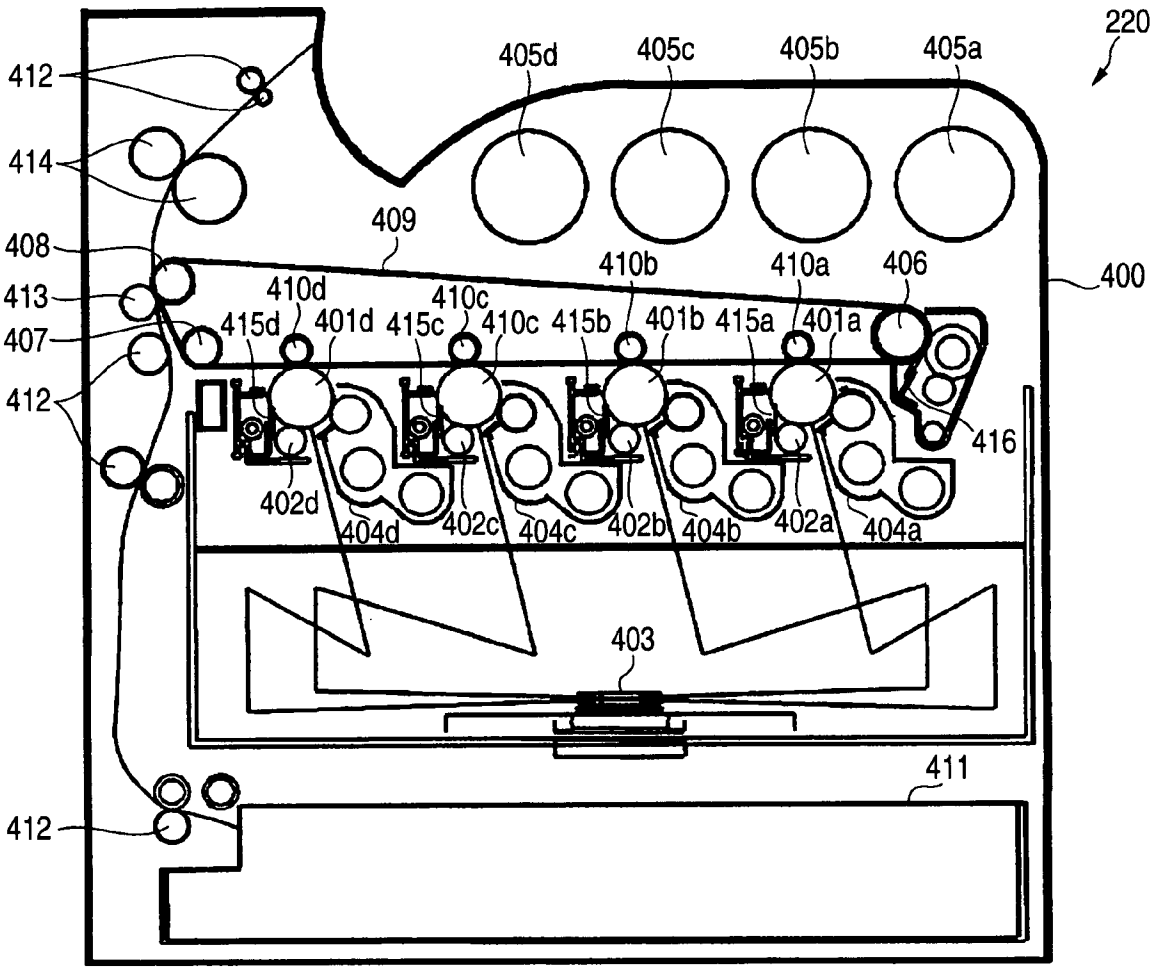
FIG. 3 is a schematic view showing another preferred embodiment of an image forming apparatus of the invention.

FIG. 3 is a cross sectional view showing another embodiment of the image forming apparatus of the invention. The image forming apparatus 220 shown in FIG. 3 is an image forming apparatus of an intermediate transfer system, and four electrophotographic photoreceptors 401*a* to 401*d* are arranged in parallel with each other along an intermediate transfer belt 409 in a housing 400.

Here, the electrophotographic photoreceptors 401*a* to 401*d* carried by the image forming apparatus 220 are each the electrophotographic photoreceptors of the invention. For example, the electrophotographic photoreceptors shown in FIG. 1 are carried thereby.

Each of the electrophotographic photoreceptors 401*a* to 401*d* is rotatable in a predetermined direction (counterclockwise on the sheet of FIG. 3), and charging rolls 402*a* to 402*d*, developing device 404*a* to 404*d*, primary transfer rolls 410*a* to 410*d* and cleaning blades 415*a* to 415*d* are each arranged along the rotational direction thereof. In each of the developing device 404*a* to 404*d*, four-color toners of yellow (Y), magenta (M), cyan (C) and black (B) contained in toner cartridges 405*a* to 405*d* can be supplied, and the primary transfer rolls 410*a* to 410*d* are each brought into abutting contact with the electrophotographic photoreceptors 401*a* to 401*d* through an intermediate transfer belt 409.

Further, a laser light source (exposure unit) 403 is arranged at a specified position in the housing 400, and it is possible to irradiate surfaces of the electrophotographic photoreceptors 401*a* to 401*d* after charging with laser light emitted from the laser light source 403. This performs the respective steps of charging, exposure, development, primary transfer and cleaning in turn in the rotation step of the electrophotographic photoreceptors 401*a* to 401*d*, and toner images of the respective colors are transferred onto the intermediate transfer belt 409, one over the other.

The intermediate transfer belt 409 is supported with a driving roll 406, a backup roll 408 and a tension roll 407 at a specified tension, and rotatable by the rotation of these rolls without the occurrence of deflection. Further, a secondary transfer roll 413 is arranged so that it is brought into abutting contact with the backup roll 408 through the intermediate transfer belt 409. The intermediate transfer belt 409 which has passed between the backup roll 408 and the secondary transfer roll 413 is cleaned up by a cleaning blade 416, and then repeatedly subjected to the subsequent image formation process.

Further, a tray (tray for a medium to which a toner image is to be transferred) 411 is provided at a specified position in the housing 400. The medium to which the toner image is to be transferred (such as paper) in the tray 411 is conveyed in turn between the intermediate transfer belt 409 and the secondary transfer roll 413, and further between two fixing rolls 414 brought into abutting contact with each other, with a conveying roll 412, and then delivered out of the housing 400.

According to the image forming apparatus 220 shown in FIG. 3, the use of the electrophotographic photoreceptors of the invention as the electrophotographic photoreceptors 401*a* to 401*d* achieves discharge gas resistance, mechanical strength, scratch resistance, etc. on a sufficiently high level in the image formation process of each of the electrophotographic photoreceptors 401*a* to 401*d*. Accordingly, even when the photoreceptors are used together with the contact charging devices or the cleaning blades, or further with the spherical toner obtained by chemical polymerization, good image quality can be obtained without the occurrence of image defects such as fogging. Therefore, also according to the image forming apparatus for color image formation using the intermediate transfer body, such as this embodiment, the image forming apparatus which can stably provide good image quality for a long period of time is realized.

The invention should not be construed as being limited to the above-mentioned embodiments. For example, each apparatus shown in FIG. 2 or 3 may be equipped with a process cartridge comprising the electrophotographic photoreceptor 1 (or the electrophotographic photoreceptors 401*a* to 401*d*) and charging device 2 (or the charging devices 402*a* to 402*d*). The use of such a process cartridge allows maintenance to be performed more simply and easily.

Further, in these embodiments, also when a charging device of the non-contact charging system such as a corotron charger is used in place of the contact charging device 2 (or the contact charging devices 402*a* to 402*d*), sufficiently good image quality can be obtained. However, from the viewpoint of the prevention of ozone generation, the contact charging device is preferably used.

Furthermore, in the apparatus shown in FIG. 2, a toner image formed on the surface of the electrophotographic photoreceptor 1 is directly transferred to the medium P to which the toner image is to be transferred. However, the image forming apparatus of the invention may be further provided with an intermediate transfer body. This makes it possible to transfer the toner image from the intermediate transfer body to the medium P to which the toner image is to be transferred, after the toner image on the surface of the electrophotographic photoreceptor 1 has been transferred to the intermediate transfer body. As such an intermediate transfer body, there can be used one having a structure in which an elastic layer containing a rubber, an elastomer, a resin or the like and at least one covering layer are laminated on a conductive support.

In addition, the image forming apparatus of the invention may be further equipped with a static eliminator such as an erase light irradiation device. This prevents the phenomenon of incorporating the residual potential of the electrophotographic photoreceptor into the subsequent cycle, when the electrophotographic photoreceptor is repeatedly used. Accordingly, image quality can be more improved.

EXAMPLES

The invention will be illustrated in greater detail with reference to the following Examples and Comparative Examples, but the invention should not be construed as being limited thereto. In the following examples and comparative examples, all the "parts" are given by weight unless otherwise indicated.

Further, the compounds shown in Tables 1 to 5 and the compounds represented by formulas (VI-1) to (VI-16) are indicated with reference to the compound number in Tables 1 to 5 or the formula number.

Example 1

Preparation of Electrophotographic Photoreceptor

A coating solution for an underlayer comprising 100 parts of a zirconium compound (trade name: Orgatics ZC540, manufactured by Matsumoto Chemical Industry Co., Ltd.), 10 parts of a silane compound (trade name: A110, manufactured by Nippon Unicar Co., Ltd.), 400 parts of isopropanol and 200 parts of butanol was prepared. This coating solution was applied onto a cylindrical Al substrate subjected to honing treatment by dip coating, and dried by heating at 150° C. for 10 minutes to form an underlayer having a film thickness of 0.1 μm.

Then, as a charge generation substance, 10 parts of chlorogallium phthalocyanine crystals having strong diffraction peaks at Bragg angles (2θ±0.2°) of 7.4°, 16.6°, 25.5° and 28.3° in an X-ray diffraction spectrum was mixed with 10 parts of a polyvinyl butyral resin (trade name: S-LEC BM-S, manufactured by Sekisui Chemical Co., Ltd.) and 1,000 parts of butyl acetate, and the resulting mixture was dispersed by treating it together with glass beads in a paint shaker for one hour to obtain a coating solution for a charge generation layer. This coating solution was applied onto the above-mentioned underlayer by dip coating, and dried by heating at 100° C. for 10 minutes to form the charge generation layer having a film thickness of about 0.15 μm.

Further, 20 parts of a benzidine compound represented by the following structural formula (33), 30 parts of a bisphenol (z) polycarbonate resin (viscosity average molecular weight: $4.4\times10^4$), 5 parts of 3-(3,3,3-trifluoropropyl)methylcyclotrisiloxane, 150 parts of monochlorobenzene and 150 parts of tetrahydrofuran were mixed to obtain a coating solution for a charge transfer layer. This coating solution was applied onto the above-mentioned charge generation layer by dip coating, and dried by heating at 115° C. for one hour to form the charge generation layer having a film thickness of 20 μm.

(33)

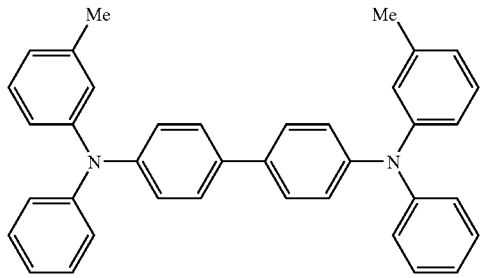

Further, 20 parts of compound (VI-3), 20 parts of compound (III-3) and 20 parts of methanol were mixed, and 2 parts of an ion exchange resin (Amberlist 15E) was added thereto, followed by stirring for 2 hours. Furthermore, 50 parts of butanol and 9.8 parts of distilled water were added to this mixture, followed by stirring at room temperature for 15 minutes. Then, the resulting mixture was filtered to remove the ion exchange resin. One part of aluminum trisacetylacetonate, 1 part of acetylacetone, 5 parts of a polyvinyl butyral resin (trade name: S-LEC KW-1, manufactured by Sekisui Chemical Co., Ltd.) and 1 part of a hindered phenol antioxidant (Sumilizer MDP-S) were added to a filtrate obtained, and thoroughly dissolved therein to obtain a coating solution for a protective layer. This coating solution was applied onto the above-mentioned charge transfer layer by dip coating (coating speed: about 170 mm/min), and dried by heating at 130° C. for one hour to form the protective layer having a film thickness of 3 μm, thereby obtaining a desired electrophotographic photoreceptor.

Examples 2 to 9

In each of Examples 2 to 9, an underlayer, a charge generation layer and a charge transfer layer were formed in the same manner as with Example 1.

Then, a coating solution for formation of a protective layer was prepared in the same manner as with Example 1 with the exception that the kinds and amounts compounded of silicon compound, charge transfer substance, resin soluble in the liquid component and antioxidant, and the amount of water compounded were changed as shown in Tables 6 and 7. Of the materials shown in Tables 6 and 7, ones indicated by trade names are as follows:

Silicon Compound:

- X-40-2239 (manufactured by Shin-Etsu Chemical Co., Ltd.)

Resins Soluble in Liquid Component:

- S-LEC KW-1 (a polyvinyl acetal resin, manufactured by Sekisui Chemical Co., Ltd.)
- S-LEC BM-1 (a polyvinyl butyral resin, manufactured by Sekisui Chemical Co., Ltd.)
- S-LEC BXL (a polyvinyl acetal resin, manufactured by Sekisui Chemical Co., Ltd.)
- DAIAMID X1874M (a polyamide resin, manufactured by DAICELIHULS LTD.)
- SK-105 (a phenol resin, manufactured by Sumitomo Bakelite Co., Ltd.)

Antioxidants:

- Sumilizer MDP-S (a hindered phenol antioxidant, manufactured by Sumitomo Chemical Co., Ltd.)
- Sumilizer BHT-R (a hindered phenol antioxidant, manufactured by Sumitomo Chemical Co., Ltd.)
- Sanol LS765 (a hindered amine antioxidant, manufactured by Sankyo Co., Ltd.)
- Tinuvin 144 (a hindered amine antioxidant, manufactured by Ciba-Geigy Corporation)

Other Components:

- R812 (silica sol, manufactured Aerosil Co., Ltd.)
- Lubron L1 (fine fluorine particles, manufactured by Daikin Industries, Ltd.)

Further, butanol was added to the coating solution to adjust the viscosity so as to give a coating speed of about 170 mm/min in dip coating. The coating solution adjusted in viscosity was applied onto the charge transfer layer (coating speed: about 170 mm/min), and dried by heating at 130° C. for one hour to form the protective layer having a film thickness of 3 μm, thereby obtaining a desired electrophotographic photoreceptor.

Example 10

An underlayer and a charge generation layer were formed in the same manner as with Example 1.

Then, a coating solution for formation of a protective layer was prepared in the same manner as with Example 1 with the exception that the kinds and amounts compounded of silicon compound, charge transfer substance, resin soluble in the liquid component, antioxidant and the other component, and the amount of water compounded were changed as shown in Table 7. Further, butanol was added to the coating solution to adjust the viscosity so as to give a coating speed of about 170 mm/min in dip coating. The coating solution adjusted in viscosity was subjected to dispersing treatment together with glass beads in a paint shaker for 30 minutes. The resulting coating solution was applied onto the charge transfer layer (coating speed: about 170 mm/min), and dried by heating at 130° C. for one hour to form the protective layer having a film thickness of 3 μm, thereby obtaining a desired electrophotographic photoreceptor.

Example 11

An electrophotographic photoreceptor was prepared in the same manner as with Example 5 with the exception that 10 parts of hydroxygallium phthalocyanine crystals having strong diffraction peaks at Bragg angles (2θ±0.2°) of 7.5°, 9.9°, 12.5°, 16.3°, 18.6°, 25.1° and 28.3° in an X-ray diffraction spectrum was used as the charge generation substance.

Comparative Examples 1 to 4

In each of Comparative Examples 1 to 4, an underlayer, a charge generation layer and a charge transfer layer were formed in the same manner as with Example 1.

Then, a coating solution for formation of a protective layer was prepared in the same manner as with Example 1 with the exception that the kinds and amounts compounded of silicon compound, charge transfer substance, resin soluble in the liquid component and antioxidant, and the amount of water compounded were changed as shown in Table 7. Further, butanol was added to the coating solution to adjust the viscosity so as to give a coating speed of about 170 mm/min in dip coating. The coating solution adjusted in viscosity was applied onto the charge transfer layer (coating speed: about 170 mm/min), and dried by heating at 130° C. for one hour to form the protective layer having a film thickness of 3 μm, thereby obtaining a desired electrophotographic photoreceptor.

Comparative Example 5

An electrophotographic photoreceptor was prepared in the same manner as with Example 10 with the exception that S-LEC BXL was not used.

Figure 4:
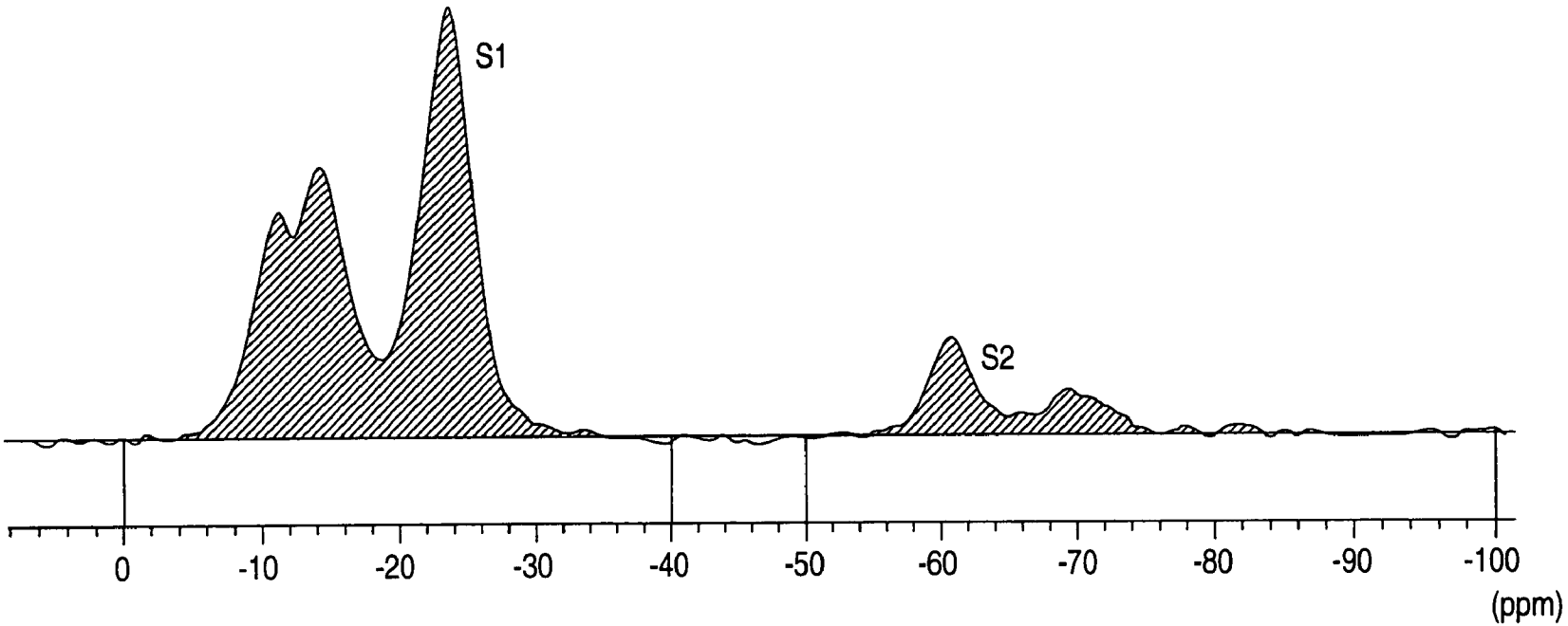
FIG. 4 is a graph showing a $^{29}$SI-NMR spectrum of the electrophotographic photoreceptor obtained in Example 3.

The values of $S_1/(S_1+S_2)$ (the left side of equation (1)) in the $^{29}$Si-NMR spectra of the electrophotographic photoreceptors obtained in Examples 1 to 11 and Comparative Examples 1 to 5, and the values of $(N_{a=3}+N_{c\geqq 3})/N_{total}$ (the left side of equation (5)) for the silicon compounds in the coating solutions for formation of the protective layers are shown in Table 8. Further, the $^{29}$Si-NMR spectrum of the electrophotographic photoreceptor obtained in Example 3 is shown in FIG. 4.

TABLE 6

| | Silicon Compound and Charge Transfer Substance | | Resin Soluble in Liquid Component | | Antioxidant | | Water |
|---|---|---|---|---|---|---|---|
| | Kind | Amount Compounded (parts) | Kind | Amount Compounded (parts) | Kind | Amount Compounded (parts) | Amount Compounded (parts) |
| Example 1 | VI-3 | 20 | S-LEC KW-1 | 5 | Sumilizer | 1 | 9.8 |
| | III-3 | 20 | | | MDP-S | | |
| Example 2 | V-17 | 20 | S-LEC BM-1 | 5 | Sumilizer | 1 | 12.1 |
| | III-3 | 20 | | | MDP-S | | |
| Example 3 | V-32 | 20 | S-LEC BM-1 | 5 | Sumilizer | 1 | 8.4 |
| | 1H, 1H, 2H, 2H-Perfluorotrioctyltriethoxysilane | 10 | | | BHT-R | | |
| | Dimethyldimethoxysilane | 10 | | | | | |
| Example 4 | V-31 | 20 | S-LEC BM-1 | 5 | Sumilizer | 1 | 12.0 |
| | III-3 | 20 | | | BHT-R | | |
| Example 5 | V-32 | 20 | S-LEC BXL | 5 | Sumilizer | 1 | 13.1 |
| | III-3 | 20 | | | BHT-R | | |
| Example 6 | V-47 | 20 | S-LEC BXL | 5 | Sanol LS765 | 1 | 5.0 |
| | X-40-2239 | 20 | | | | | |
| Example 7 | V-40 | 20 | S-LEC BXL | 5 | Sanol LS765 | 1 | 16.7 |
| | III-2 | 20 | | | | | |
| Example 8 | V-60 | 30 | DAIAMID | 5 | Sanol LS765 | 1 | 17.6 |
| | Methyltrimethoxysilane | 15 | X1874M | | | | |
| | Dimethyldimethoxysilane | 5 | | | | | |

TABLE 7

| | Silicon Compound and Charge Transfer Substance | | Resin Soluble in Liquid Component | | Antioxidant | | Water | Other Component | |
|---|---|---|---|---|---|---|---|---|---|
| | Kind | Amount Compounded (parts) | Kind | Amount Compounded (parts) | Kind | Amount Compounded (parts) | Amount Compounded (parts) | Kind | Amount Compounded (parts) |
| Example 9 | V-60 | 20 | SK-105 | 5 | Tinuvin | 1 | 13.9 | — | — |
| | III-2 | 20 | | | 144 | | | | |
| Example 10 | V-47 | 20 | S-LEC | 5 | Sumilizer | 1 | 8.5 | R812 | 10 |
| | III-2 | 10 | BXL | | BHT-R | | | Lubron L1 | 5 |
| Example 11 | V-32 | 20 | S-LEC | 10 | Sumilizer | 1 | 13.1 | — | — |
| | III-3 | 20 | BXL | | BHT-R | | | | |
| Comparative | V-17 | 20 | — | — | Tinuvin | 1 | 12.1 | — | — |
| Example 1 | III-3 | 20 | | | 144 | | | | |
| Comparative | V-32 | 20 | — | — | Sumilizer | 1 | 13.1 | — | — |
| Example 2 | III-3 | 20 | | | BHT-R | | | | |
| Comparative | V-60 | 30 | DAIAMID | 5 | Sanol | 1 | 18.2 | — | — |
| Example 3 | Methyltrimethoxysilane | 20 | X1874M | | LS765 | | | | |
| | Dimethyldimethoxysilane | 5 | | | | | | | |
| Comparative | V-32 | 25 | S-LEC | 5 | Tinuvin | 1 | 10.2 | — | — |
| Example 4 | III-3 | 5 | BXL | | 144 | | | | |
| | III-4 | 20 | | | | | | | |
| Comparative | V-32 | 20 | — | — | Sumilizer | 1 | 13.1 | R812 | 5 |
| Example 5 | III-3 | 20 | | | BHT-R | | | Lubron L1 | 5 |

TABLE 8

| | $S_1/(S_1 + S_2)$ | $(N_{a-3} + N_{c\geq 3})/N_{total}$ | Pot Life |
|---|---|---|---|
| Example 1 | 1 | 0 | B |
| Example 2 | 1 | 0 | B |
| Example 3 | 0.81 | 0.132 | A |
| Example 4 | 0.72 | 0.235 | A |
| Example 5 | 1 | 0 | B |
| Example 6 | 0.68 | — | B |
| Exam le 7 | 0.63 | 0.340 | B |
| Example 8 | 0.51 | 0.491 | B |
| Example 9 | 1 | 0 | B |
| Example 10 | 0.79 | — | B |
| Example 11 | 1 | 0 | A |
| Comparative Example 1 | 1 | 0 | C |
| Comparative Example 2 | 1 | — | D |
| Comparative Example 3 | 1 | 0.235 | C |
| Comparative Example 4 | 0.37 | — | C |
| Comparative Example 5 | 0.41 | 0.563 | E |

Pot Life Evaluation Test of Coating Solution

The coating solution for formation of the protective layer used in each of Examples 1 to 11 and Comparative Examples 1 to 5 was poured into a sample bottle, and the bottle was sealed hermetically. The time required from the time this sample bottle was maintained at a temperature of 40° C. until gelation, separation or precipitation occurred was measured, and the pot life of the coating solution was evaluated on the basis of the following criteria:

A: 20 days or more

B: From 10 days to less than 20 days

C: From 5 days to less than 10 days

D: From 2 days to less than 5 days

E: Less than 2 days

As shown in Table 8, it was confirmed that the coating solutions for formation of the protective layers used in Examples 1 to 11 each had a sufficiently long pot life.

Print Test

Using the electrophotographic photoreceptors obtained in each of Examples 1 to 11 and Comparative Examples 1 to 5, the image forming apparatus shown in FIG. 3 was fabricated. As elements other than the electrophotographic photoreceptor, ones similar to those of Docu Centre Color 400 CP (manufactured by Fuji Xerox Co., Ltd.) were used.

Then, using the resulting image forming apparatus, color print test by yellow (Y), magenta (M), cyan (C) and black (K) were carried out. The tests were carried out under 3 conditions; low temperature and low humidity (10° C. and 15% RH), normal temperature and normal humidity (20° C. and 40% RH) and high temperature and high humidity (30° C. and 85% RH), and the initial image quality and surface state of the electrophotographic photoreceptors, the image quality and surface state of the electrophotographic photoreceptors after 10,000 prints, and the state of the blades after 10,000 prints were evaluated. The surface state was evaluated for the respective electrophotographic photoreceptors of yellow (Y), magenta (M), cyan (C) and black (K) on the basis of the following criteria:

A: Neither a scratch nor a deposit is observed.

B: Scratches or deposits are slightly observed (observable under a microscope).

C: Scratches or deposits are slightly observed (observable through a magnifier).

D: Scratches or deposits are observed (observable by the naked eye).

E: Scratches or deposits are significantly observed (observable by the naked eye). The results obtained are shown in Table 9.

TABLE 9

| | Image Quality | | | | | | | Surface of Photoreceptor | | | | | | | | | | | |
|---|---|---|---|---|---|---|---|---|---|---|---|---|---|---|---|---|---|---|---|
| | Initial | | | After 10,000 Prints | | | | After 10,000 Prints | | | | | | | | | | | |
| | Low Temp. and Low Humidity | Normal Temp. and Normal Humidity | High Temp. and High Humidity | Low Temp. and Low Humidity | Normal Temp. and Normal Humidity | High Temp. and High Humidity | Initial | Low Temp. and Low Humidity | | | | Normal Temp. and Normal Humidity | | | | High Temp. and High Humidity | | | |
| | | | | | | | | Y | M | C | K | Y | M | C | K | Y | M | C | K |
| Example 1 | Good | Good | Good | Good | Good | Good | A | B | B | B | B | A | B | B | B | A | B | B | B |
| Example 2 | Good | Good | Good | Good | Good | Good | A | A | A | B | B | A | B | A | B | A | A | B | A |
| Example 3 | Good | Good | Good | Good | Good | Good | A | A | A | A | B | A | A | A | B | A | A | A | B |
| Example 4 | Good | Good | Good | Good | Good | Good | A | A | A | B | B | A | A | A | B | A | A | A | A |
| Example 5 | Good | Good | Good | Good | Good | Good | A | A | A | A | B | A | A | A | B | A | A | B | B |
| Example 6 | Good | Good | Good | Good | Good | Good | A | A | B | B | B | A | A | A | B | A | A | A | B |
| Example 7 | Good | Good | Good | Good | Good | Good | A | A | A | A | B | A | A | A | A | A | A | A | B |
| Example 8 | Good | Good | Good | Good | Good | Good | A | A | A | B | B | A | A | A | B | A | A | B | B |
| Example 9 | Good | Good | Good | Good | Good | Good | A | A | A | A | B | A | A | B | B | A | A | A | B |
| Example 10 | Good | Good | Good | Good | Good | Good | A | A | A | A | B | A | A | A | B | A | A | A | A |
| Example 11 | Good | Good | Good | Good | Good | Good | A | A | A | A | B | A | A | A | B | A | A | A | B |
| Comparative Example 1 | Good | Good | Good | Slight streaks | Good | Good | A | C | C | D | D | B | B | C | C | B | B | B | B |
| Comparative Example 2 | Good | Good | Good | Slight indistinct image | Good | Good | A | A | A | B | C | A | A | A | B | A | A | A | A |
| Comparative Example 3 | Good | Good | Good | Slight indistinct image | Good | Good | A | A | A | C | C | A | A | B | B | A | A | A | B |
| Comparative Example 4 | Good | Good | Good | Slight indistinct image | Good | Good | A | A | B | C | C | A | A | B | B | A | A | A | B |

TABLE 9-continued

| | | | | | | | | | | | | | | | | | | |
|---|---|---|---|---|---|---|---|---|---|---|---|---|---|---|---|---|---|---|
| Comparative Example 5 | Good | Good | Slight image deletion | Slight indistinct image | Good | Good | A | A | A | C | C | C | C | C | D | D | D | D | D |

| | Blade after 10,000 Prints | | |
|---|---|---|---|
| | Low Temp. and Low Humidity | Normal Temp. and Normal Humidity | High Temp. and High Humidity |
| Example 1 | Good | Good | Good |
| Example 2 | Good | Good | Good |
| Example 3 | Good | Good | Good |
| Example 4 | Good | Good | Good |
| Example 5 | Good | Good | Good |
| Example 6 | Good | Good | Good |
| Example 7 | Good | Good | Good |
| Example 8 | Good | Good | Good |
| Example 9 | Good | Good | Good |
| Example 10 | Good | Good | Good |
| Example 11 | Good | Good | Good |
| Comparative Example 1 | Slight Breakage | Good | Good |
| Comparative Example 2 | Slight Breakage | Good | Good |
| Comparative Example 3 | Slight Breakage | Good | Good |
| Comparative Example 4 | Slight Breakage | Good | Good |
| Comparative Example 5 | Slight Breakage | Good | Good |

As shown in FIG. 9, in the case of the image forming apparatus carrying the electrophotographic photoreceptors of Examples 1 to 11, it was confirmed that the image quality, the surface state of the photoreceptors and the state of the cleaning blades were good even after 10,000 prints.

As described above, according to the invention, there can be provided the electrophotographic photoreceptor which is sufficiently high in stain resistance against a developing agent, a discharge product, etc. and in durability against a contact charger, a cleaning blade, etc., and further, which can prevent the occurrence of coating defects in the production thereof; and the process cartridge and the image forming apparatus which can provide good image quality for a long period of time.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5 \quad (1).$$

2. The electrophotographic photoreceptor according to claim 1, wherein the silicon compound-containing layer is formed from a coating solution, and the resin contained in the silicon compound-containing layer is a resin soluble in a liquid component in the coating solution used for formation of the silicon compound-containing layer.

3. The electrophotographic photoreceptor according to claim 1, having a value of $S_1/(S_1+S_2)$ in formula (1) of 0.6 or more.

4. The electrophotographic photoreceptor according to claim 1, wherein the silicon compound contains two or more silicon atoms in its molecule.

5. The electrophotographic photoreceptor according to claim 1, wherein the silicon compound-containing layer contains at least one of silicon-containing compounds represented by the following general formulas (2) to (4) or a hydrolysate or hydrolytic condensate thereof:

$$W^1(\text{—}SiR_{3-a}Q_a)_2 \quad (2)$$

$$W^2(\text{-}D\text{-}SiR_{3-a}Q_a)_b \quad (3)$$

$$SiR_{4-c}Q_c \quad (4)$$

wherein $W^1$ represents a divalent organic group, $W^2$ represents an organic group derived from a compound having hole transport capability, R represents a member selected from the group consisting of a hydrogen atom, an alkyl group and a substituted or unsubstituted aryl group, Q represents a hydrolytic group, D represents a divalent group, a represents an integer of 1 to 3, b represents an integer of 2 to 4, and c represents an integer of 1 to 4.

6. The electrophotographic photoreceptor according to claim 5, wherein the number of silicon atoms derived from the silicon-containing compounds represented by the following general formulas (2) to (4) in the silicon compound-containing layer satisfies the following equation (5):

$$(N_{a=3}+N_{c\geqq 3})/N_{total} \leqq 0.5 \quad (5)$$

wherein $N_{a=3}$ represents the number of silicon atoms derived from $\text{—}SiR_{3-a}Q_a$ of the silicon compound represented by general formula (2) or (3) in which a is 3, $N_{c\geqq 3}$ represents the number of silicon atoms derived from the silicon compound represented by general formula (4) in which c is 3 or 4, and $N_{total}$ represents the total of the number of silicon atoms derived from $—SiR_{3-a}Q_a$ of the silicon compound represented by general formula (2) or (3) and the number of silicon atoms derived from the silicon compound represented by general formula (4).

7. The electrophotographic photoreceptor according to claim 1, wherein the silicon compound-containing layer contains a compound which is the silicon compound represented by general formula (3) wherein $W^2$ is an organic group represented by the following general formula (6), or a hydrolysate or hydrolytic condensate thereof:

(6)

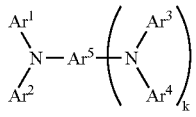

wherein $Ar^1$, $Ar^2$, $Ar^3$ and $Ar^4$, which may be the same or different, each represents a substituted or unsubstituted aryl group, $Ar^5$ represents a substituted or unsubstituted aryl or arylene group, k represents 0 or 1, and at least one of $Ar^1$ to $Ar^5$ has a bonding hand to connect with $-D-SiR_{3-a}Q_a$ in general formula (3).

8. The electrophotographic photoreceptor according to claim 1, wherein the silicon compound-containing layer further contains at least one kind of fine particles.

9. The electrophotographic photoreceptor according to claim 8, wherein the fine particles contain a silicon atom or a fluorine atom.

10. A process cartridge comprising:

an electrophotographic photoreceptor; and at least one of: a developing unit for developing an electrostatic latent image formed on the electrophotographic photoreceptor to form a toner image; and a cleaning unit for removing toner remaining on the electrophotographic photoreceptor after transfer of the toner image, wherein the electrophotographic photoreceptor comprises a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5 \quad (1).$$

11. An image forming apparatus comprising:

an electrophotographic photoreceptor;

a charging unit for charging the electrophotographic photoreceptor;

an exposing unit for exposing the charged electrophotographic photoreceptor to form an electrostatic latent image;

a developing unit for developing the electrostatic latent image to form a toner image;

a transfer unit for transferring the toner image to a medium to which the toner image is to be transferred; and a cleaning unit for removing toner remaining on the electrophotographic photoreceptor after the transfer of the toner image, wherein the electrophotographic photoreceptor comprises a conductive support and a photosensitive layer disposed on the conductive support, wherein the photosensitive layer comprises a silicon compound-containing layer containing a silicon compound, and the silicon compound-containing layer further contains a resin, and wherein the photosensitive layer has a peak area in the region of −40 to 0 ppm ($S_1$) and a peak area in the region of −100 to −50 ppm ($S_2$) in a $^{29}$Si-NMR spectrum satisfying the following equation (1):

$$S_1/(S_1+S_2) \geqq 0.5 \quad (1).$$

12. The image forming apparatus according to claim 11, wherein the transfer unit is an intermediate transfer body for temporarily transferring the toner image formed on the electrophotographic photoreceptor.

13. The image forming apparatus according to claim 12, having a plurality of electrophotographic photoreceptors arranged along the intermediate transfer body.

* * * * *